US007018254B2

(12) United States Patent
Kanno et al.

(10) Patent No.: US 7,018,254 B2
(45) Date of Patent: Mar. 28, 2006

(54) FUEL INJECTION CONTROL FOR MARINE ENGINE

(75) Inventors: Isao Kanno, Hamamatsu (JP); Seiji Inoue, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/873,850

(22) Filed: Jun. 22, 2004

(65) Prior Publication Data

US 2004/0266285 A1 Dec. 30, 2004

Related U.S. Application Data

(63) Continuation-in-part of application No. 10/113,317, filed on Mar. 29, 2002, now Pat. No. 6,752,672.

(30) Foreign Application Priority Data

Apr. 11, 2001 (JP) ..... 2001-112641
Sep. 21, 2001 (JP) ..... 2001-288522

(51) Int. Cl.
*B63H 21/21* (2006.01)

(52) U.S. Cl. ..... 440/87; 440/1

(58) Field of Classification Search ..... 440/1, 440/87

See application file for complete search history.

(56) References Cited

U.S. PATENT DOCUMENTS 4,385,601 A 5/1983 Orova et al.
4,492,197 A 1/1985 Yamamoto et al.
4,594,978 A 6/1986 Kanno
4,708,669 A 11/1987 Kanno et al.
4,734,065 A 3/1988 Nakahama et al.
4,767,363 A 8/1988 Uchida et al.
4,850,318 A 7/1989 Torigai et al.
4,898,137 A 2/1990 Fujita et al.
4,909,764 A 3/1990 Hirukawa et al.
4,951,640 A 8/1990 Hirukawa et al.
5,056,483 A 10/1991 Ohuchi
5,117,792 A 6/1992 Kanno
5,136,279 A 8/1992 Kanno
5,170,065 A 12/1992 Shimizu et al.
5,364,322 A * 11/1994 Fukui ..... 477/108
5,450,828 A 9/1995 Sakamoto et al.
5,606,952 A 3/1997 Kanno et al.
5,615,645 A 4/1997 Kanno
5,669,349 A 9/1997 Iwata et al.
5,782,659 A 7/1998 Motose
5,941,743 A 8/1999 Kato
5,970,951 A 10/1999 Ito
6,019,090 A 2/2000 Ozawa
6,079,389 A 6/2000 Ono et al.
6,135,918 A 10/2000 Bellinger et al.
6,223,723 B1 5/2001 Ito
6,325,046 B1 12/2001 Kanno
6,474,298 B1 11/2002 Kanno
6,733,350 B1 5/2004 Iida et al.
6,752,672 B1 6/2004 Kanno

* cited by examiner

*Primary Examiner*—Jesus D. Sotelo
(74) *Attorney, Agent, or Firm*—Knobbe, Martens, Olson & Bear, LLP

(57) ABSTRACT

A watercraft has an engine that is controlled to reduce the likelihood of engine damage and rider discomfort when the watercraft engine speed is rapidly increased due to a lack of load on the propulsion unit. The engine is controlled by a method that detects engine speed and reduces the power output of the engine by varying degrees or restores the power output of the engine by varying degrees depending on the speed of the engine relative to plural predetermine speeds.

17 Claims, 21 Drawing Sheets

FUEL INJECTION CONTROL FOR MARINE ENGINE

PRIORITY INFORMATION

This application is a Continuation-In-Part of U.S. patent application Ser. No. 10/113,317, filed Mar. 29, 2002 now U.S. Pat. No. 6,752,672 and is based on and claims priority to Japanese Patent Applications No. 2001-112641, filed Apr. 11, 2001, and No. 2001-288522, filed Sep. 21, 2001 the entire contents of each of which is hereby expressly incorporated by reference.

BACKGROUND OF THE INVENTION

The present application generally relates to an engine control arrangement for a watercraft, and more particularly relates to an engine management system that prevents engine damage and rider discomfort caused by excessive engine speeds.

DESCRIPTION OF THE RELATED ART

Watercraft, including personal watercraft and jet boats, are often powered by an internal combustion engine having an output shaft arranged to drive a water propulsion device. Occasionally, watercraft may leave the water at speed due to waves, thus causing sudden decreased load on the propulsion unit, which can raise the engine RPM to a damaging speed. Reentry of the watercraft into the water at high engine speed can cause an uncomfortable riding experience.

Watercraft often operate within three modes of operation: displacement mode, transition mode and planing mode. During lower speeds, the hull displaces water to remain buoyant; this is the displacement mode. At a particular watercraft speed relative to the water, a portion of the hull rises up from the water and the watercraft begins planing across the water; this is the planing mode. The transition mode occurs between the displacement mode and the planing mode and involves the range of watercraft speeds between the planing and displacement modes.

While the watercraft is planing (i.e., up on plane), the wetted surface area of the watercraft is decreased and the water resistance is substantially reduced, increasing the likelihood that the propulsion unit will leave the water. On the other hand, once the watercraft slows to a speed that brings the watercraft off plane (i.e., transition mode and/or displacement mode), the wetted surface area of the watercraft is significantly increased and the likelihood of air entering the propulsion unit is dramatically decreased.

One way of protecting the engine against over-revving is to limit the spark plugs from firing to thereby allow the engine to slow down. In two cycle engines since the spark plugs are fired every stroke, if one firing cycle of a spark plug is stopped in order to slow down the engine, engine smoothness is not significantly compromised. However, in a four cycle engine the spark plugs are fired every second stroke, so when the firing of a spark plug is omitted, a noticeable compromise in engine smoothness occurs. Additionally, in any exhaust system where an exhaust catalyst is used, the exhaust catalyst may be damaged due to unburned fuel entering the exhaust system since the fuel injectors continue to operate when the ignition spark is interrupted.

SUMMARY OF THE INVENTION

Accordingly, an engine control arrangement has been developed to better control engine speed during a decreased load on the propulsion unit in order to prevent engine damage as well as maintaining a smooth ride. In addition, the engine control arrangement can be configured to maintain a safe engine speed by controlling the throttle position and the fuel injection to varying individual cylinders or to all cylinders gradually.

Thus, one aspect of at least one of the inventions disclosed herein is directed to a method of controlling a marine engine associated with a watercraft. The method includes injecting fuel into the engine for combustion therein, sensing a first engine speed, and comparing the first sensed engine speed with a first predetermined speed. Additionally, the method includes reducing fuel injection to at least a first cylinder if the first sensed engine speed is greater than the first predetermined speed, determining if the watercraft is airborne, and restoring fuel injection to the first cylinder if the watercraft is not airborne.

Another aspect of at least one of the inventions disclosed herein is directed to a watercraft comprising a hull and a multi-cylinder engine disposed within the hull. A propulsion unit is powered by the engine. A controller is configured to control at least fuel supply to the engine. The controller is also configured to detect a speed of the engine, compare the detected engine speed with a first predetermined speed, reduce fuel supply to at least a first cylinder of the engine if the detected engine speed is greater than a first predetermined speed, determine if the watercraft is airborne, and restore fuel supply to the at least first cylinder if the watercraft is not airborne.

Further aspects, features and advantages of this invention will become apparent from the detailed description of the preferred embodiments which follow.

BRIEF DESCRIPTION OF THE DRAWINGS

The foregoing features, aspects, and advantages of at least one of the inventions disclosed herein will now be described with reference to the drawings of a preferred embodiment that is intended to illustrate and not to limit any of the inventions disclosed herein. The drawings comprise fifteen figures in which:

FIG. 15 is a block diagram showing another control routine arranged and configured in accordance with certain features, aspects and advantages of at least one of the inventions disclosed herein; and.

DETAILED DESCRIPTION OF THE PREFERRED EMBODIMENT

With reference to FIGS. 1 to 6, an overall configuration of a personal watercraft 10 and its engine 12 is described below. The watercraft 10 employs the internal combustion engine 12, which is configured in accordance with a preferred embodiment of at least one of the inventions disclosed herein. The described engine configuration and the associated control routine have particular utility for use with personal watercraft, and thus, are described in the context of personal watercraft. The engine configuration and the control routine, however, also can be applied to other types of watercraft, such as, for example, small jet boats and other vehicles.

Figure 1:
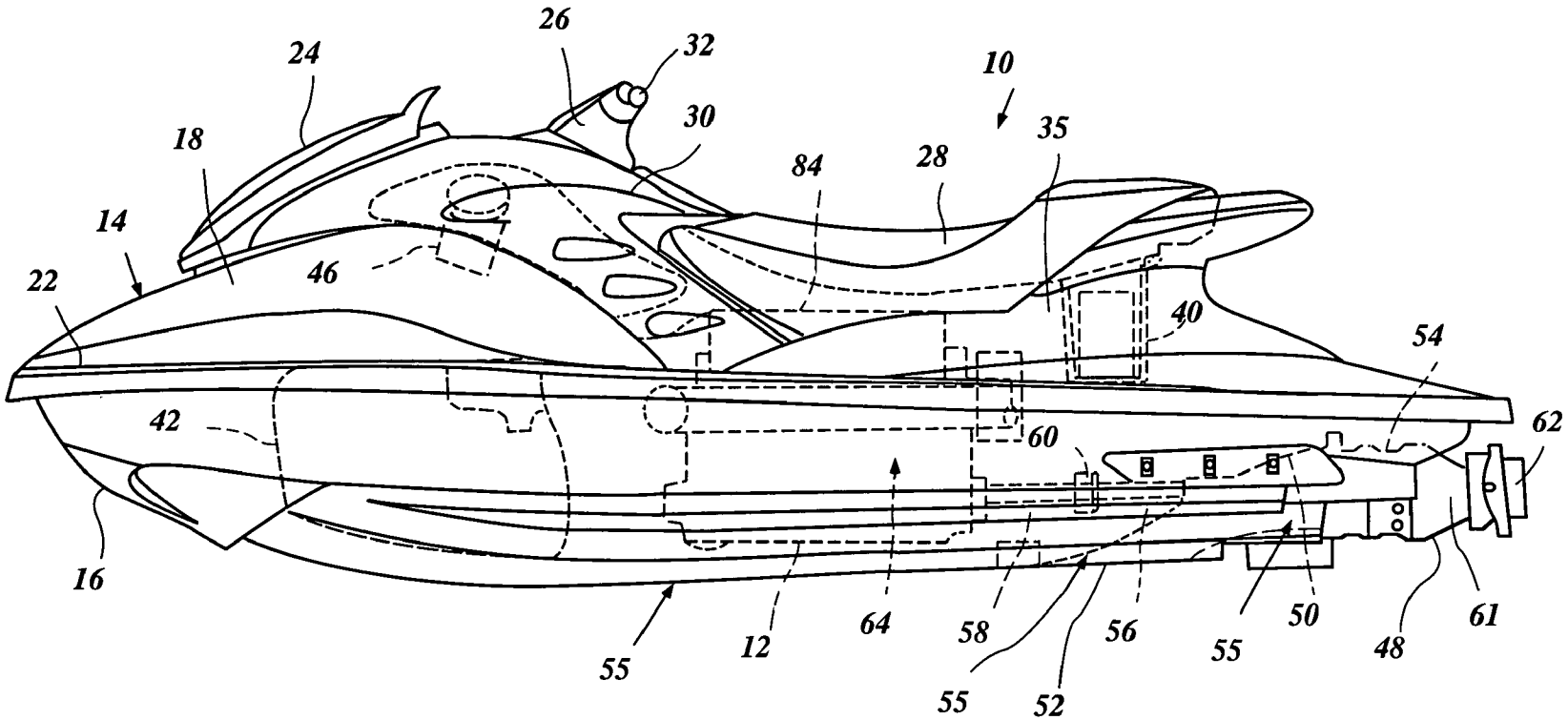
FIG. 1 is a side elevational view of a personal watercraft of the type powered by an engine controlled in accordance with certain features, aspects and advantages of at least one of the inventions disclosed herein. Several of the internal components of the watercraft (e.g., the engine) are illustrated in phantom.

With reference initially to FIG. 1, the personal watercraft 10 includes a hull 14 formed with a lower hull section 16 and an upper hull section or deck 18. The lower hull section 16 and the upper hull section 18 preferably are coupled together to define an internal cavity 20 (see FIG. 5). A bond flange 22 defines an intersection of both of the hull sections 16, 18.

The illustrated upper hull section 14 preferably comprises a hatch cover 24, a control mast 26 and a seat 28, which are arranged generally in seriatim from fore to aft.

In the illustrated arrangement, a forward portion of the upper hull section 18 defines a bow portion 30 that slopes upwardly. An opening can be provided through the bow portion 30 so the rider can access the internal cavity 20. The hatch cover 24 can be detachably affixed (e.g., hinged) to the bow portion 30 to resealably cover the opening.

The control mast 26 extends upwardly to support a handle bar 32. The handle bar 32 is provided primarily for controlling the direction of the watercraft 10. The handle bar 32 preferably carries other mechanisms, such as, for example, a throttle lever 34 that is used to control the engine output (i.e., to vary the engine speed).

The seat 28 extends rearwardly from a portion just rearward of the bow portion 30. The seat 28 is disposed atop a pedestal 35 defined by the deck 18 (see FIG. 1). In the illustrated arrangement, the seat 28 has a saddle shape. Hence, a rider can sit on the seat 28 in a straddle fashion.

Foot areas 36 are defined on both sides of the seat 28 along a portion of the top surface of the upper hull section 18. The foot areas 36 are formed generally flat but may be inclined toward a suitable drain configuration.

The seat 28 preferably is configured to close an access opening 38 formed within the pedestal 35. The access opening 38 generally provides suitable access to the internal cavity 20 and, in the illustrated arrangement, to the engine 12. Thus, when the seat 28 is removed from the pedestal 35, the engine 12 can be accessed through the opening 38. In the illustrated embodiment, the upper hull section 18 or pedestal 35 also encloses a storage box 40 that is disposed under the seat 28.

A fuel tank 42 is positioned in the cavity 20 under the bow portion 30 of the upper hull section 18 in the illustrated arrangement. A duct (not shown) preferably couples the fuel tank 42 with a fuel inlet port positioned at a top surface of the bow 30 of the upper hull section 18. A closure cap 44 (see FIG. 2) closes the fuel inlet port to inhibit water infiltration.

The engine 12 is disposed in an engine compartment defined, for instance within the cavity 20. The engine compartment preferably is located under the seat 28, but other locations are also possible (e.g., beneath the control mast or in the bow). In general, the engine compartment is defined within the cavity 20 by a forward and rearward bulkhead. Other configurations, however, are possible.

A pair of air ducts 46 are provided in the illustrated arrangement such that the air within the internal cavity 20 can be readily replenished or exchanged. The engine compartment, however, is substantially sealed to protect the engine 12 and other internal components from water.

A jet pump unit 48 propels the illustrated watercraft 10. Other types of marine drives can be used depending upon the application. The jet pump unit 48 preferably is disposed within a tunnel 50 formed on the underside of the lower hull section 16. The tunnel 50 has a downward facing inlet port 52 opening toward the body of water. A jet pump housing 54 is disposed within a portion of the tunnel 50. Preferably, an impeller (not shown) is supported within the jet pump housing 54.

One or more pressure sensors 55 can be positioned on the outer surface of the lower hull section 16 to detect if the watercraft 10 is in the water or has left the water, for example, but without limitation, when traveling at speed due to waves. Preferably, but without limitation, the pressure sensors 55 are disposed near the inlet port 52, or placed within the tunnel 50. This provides a further advantage in that the likelihood that the pressure sensors remain submerged when the watercraft is in contact with the water.

For example, when a small watercraft such as a personal watercraft is planning, only a small portion of the hull is in contact with the water. Additionally, when such a watercraft is turned, portions of the hull which are normally in contact with the water when the watercraft is moving in a straight line, can rise out of the water. However, the inlet to the jet pump is positioned in a central rear portion of the hull, and is shaped so as to maximize the likelihood that the inlet will remain submerged during all operating conditions. Thus, by placing the sensors 55 near the inlet port 52, or placed within the tunnel 50, the pressure sensors 55 are more likely to remain submerged when the watercraft 10 is turning.

The pressure sensors 55 can be used to determine if the watercraft 10 has left the water, for example, by comparing a pressure detected by at least one of the sensors 55 with a predetermined pressure, e.g. atmospheric pressure. In this example, if the detected pressure is about the same as atmospheric pressure, then it can be assumed that the watercraft 10 has left the water. On the other hand, if the detected pressure is greater than atmospheric pressure, then it can be assumed that the watercraft 10 is in the water. As such, the detection of whether or not the watercraft 10 is in the water can be used to provide a more comfortable landing when the watercraft returns to the water. For example, the engine speed can be controlled in accordance with a suitable control routine, which is disclosed in greater detail below, in order to make the landing more comfortable.

An impeller shaft 56 extends forwardly from the impeller and is coupled with a crankshaft 58 of the engine 12 by a suitable coupling device 60. The crankshaft 58 of the engine 12 thus drives the impeller shaft 56. The rear end of the housing 54 defines a discharge nozzle 61. A steering nozzle 62 is affixed proximate the discharge nozzle 61. The steering nozzle 62 can be pivotally moved about a generally vertical steering axis. The steering nozzle 62 is connected to the handle bar 32 by a cable or other suitable arrangement so that the rider can pivot the nozzle 62 for steering the watercraft.

Figure 5:
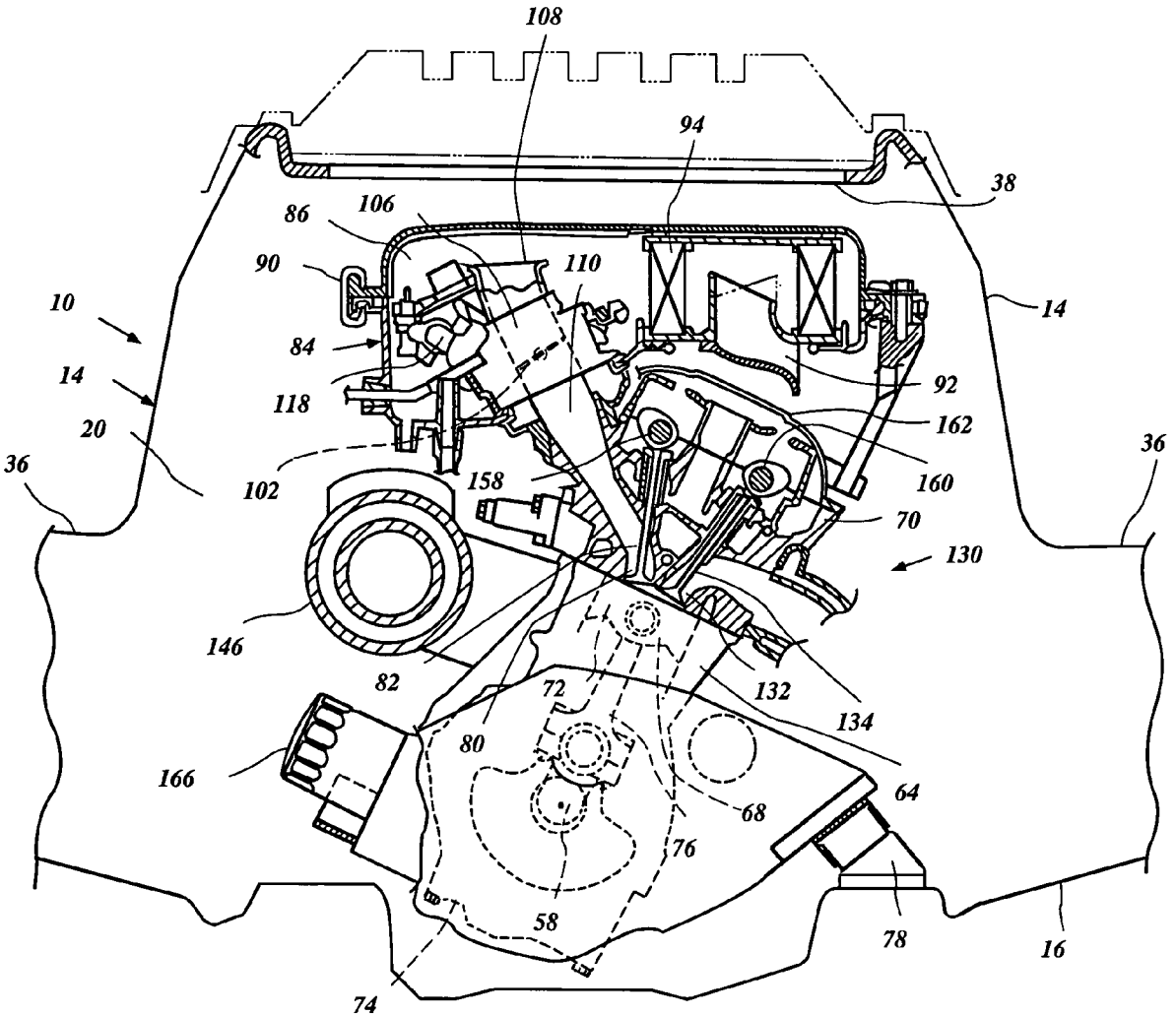
FIG. 5 is a schematic and partial cross-sectional rear view of the watercraft and the engine. A profile of a hull of the watercraft is shown schematically. Portions of the engine and an opening of an engine compartment of the hull are illustrated partially in section.

The engine 12 in the illustrated arrangement operates on a four-stroke cycle combustion principal. With reference to FIG. 5, the engine 12 includes a cylinder block 64 with four cylinder bores 66 formed side by side. FIG. 7*a* illustrates another engine configuration where the engine 12 includes a cylinder block 64 with three cylinder bores 66 formed side by side. The engine 12, thus, is an inclined L design (in-line cylinder configuration) type. The illustrated engine, however, merely exemplifies one type of engine on which various aspects and features of at least one of the inventions disclosed herein can be used. Engines having a different number of cylinders, other cylinder arrangements, other cylinder orientations (e.g., upright cylinder banks, V-type, and W-type), and operating on other combustion principles (e.g., crankcase compression two-stroke, diesel, and rotary) are all practicable. Many orientations of the engine are also possible (e.g., with a transversely or vertically oriented crankshaft).

With continued reference to FIG. 5, a piston 68 reciprocates in each of the cylinder bores 66 formed within the cylinder block 64. A cylinder head member 70 is affixed to the upper end of the cylinder block 64 to close respective upper ends of the cylinder bores 66. The cylinder head member 70, the cylinder bores 66 and the pistons 68 together define combustion chambers 72.

A lower cylinder block member or crankcase member 74 is affixed to the lower end of the cylinder block 64 to close the respective lower ends of the cylinder bores 66 and to define, in part, a crankshaft chamber. The crankshaft 58 is journaled between the cylinder block 64 and the lower cylinder block member 74. The crankshaft 58 is rotatably connected to the pistons 68 through connecting rods 76. Preferably, a crankshaft speed sensor 77 is disposed proximate the crankshaft to output a signal indicative of engine speed. In some configurations, the crankshaft speed sensor 77 is formed, at least in part, with a flywheel magneto. The speed sensor 77 also can output crankshaft position signals in some arrangements.

The cylinder block 64, the cylinder head member 70 and the crankcase member 74 together generally define an engine block of the engine 12. The engine 12 preferably is made of an aluminum-based alloy.

Engine mounts 78 preferably extend from both sides of the engine 12. The engine mounts 78 can include resilient portions made of, for example, a rubber material. The engine 12 preferably is mounted on the lower hull section 16, specifically, a hull liner, by the engine mounts 78 so that the engine 12 is greatly inhibited from conducting vibration energy to the hull section 16.

The engine 12 preferably includes an air induction system to guide air to the combustion chambers 72. In the illustrated embodiment, the air induction system includes four air intake ports 80 defined within the cylinder head member 70. The intake ports 80 communicate with the four combustion chambers 72, respectfully. Other numbers of ports can be used depending upon the application.

Intake valves 82 are provided to open and close the intake ports 80 such that flow through the ports 80 can be controlled. A camshaft arrangement that can be used to control the intake valves 82 is discussed below.

The air induction system also includes an air intake box 84 for smoothing intake airflow and acting as an intake silencer. The intake box 84 in the illustrated embodiment is generally rectangular and, along with an intake box cover 86, defines a plenum chamber 88. The intake box cover 86 can be attached to the intake box 84 with a number of intake box cover clips 90 or any other suitable fastener. Other shapes of the intake box of course are possible, but the plenum chamber preferably is as large as possible while still allowing for positioning within the space provided in the engine compartment.

Figure 6:
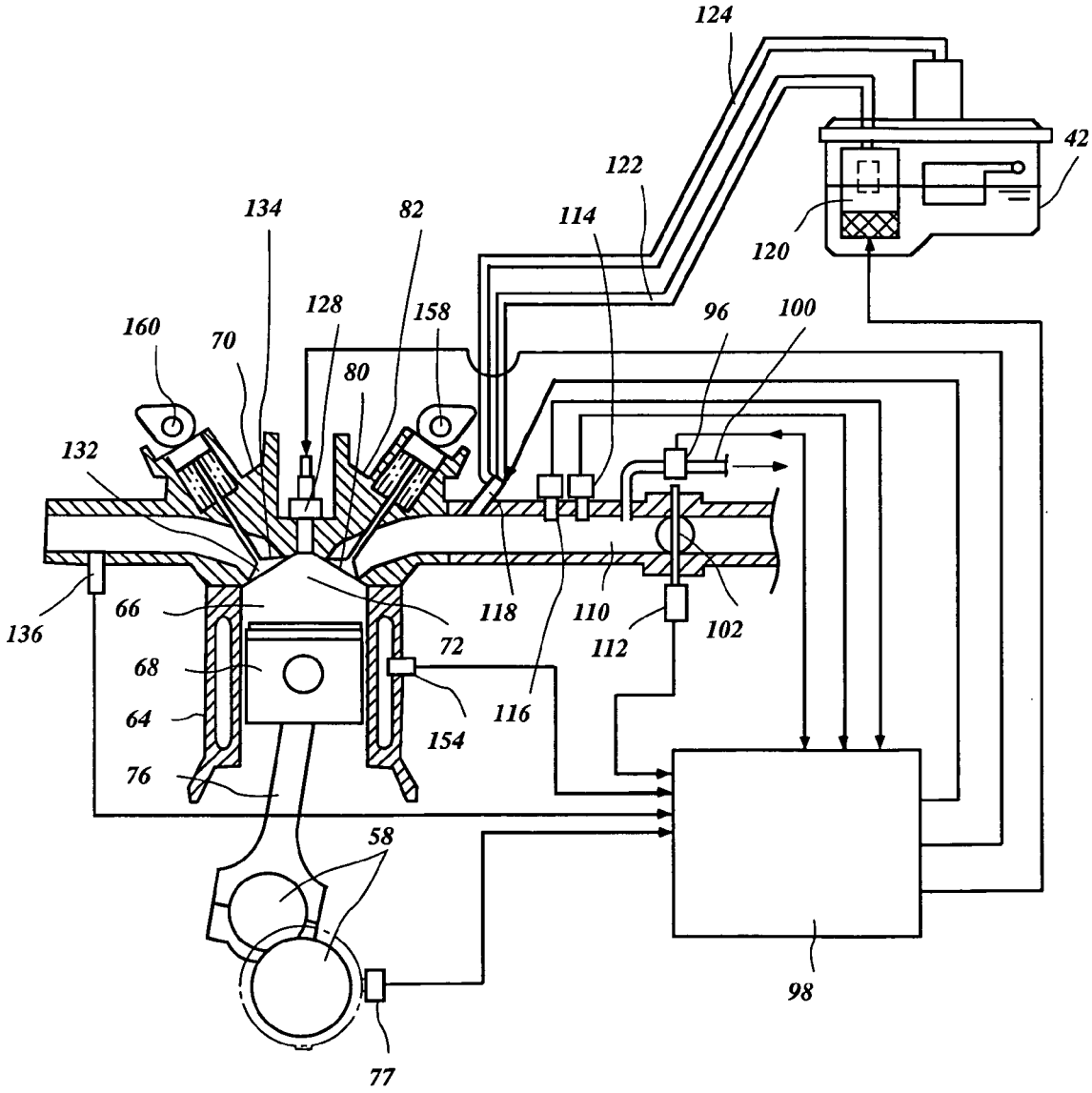
FIG. 6 is a schematic view showing the engine control system, including at least a portion of the engine in cross-section, an ECU, and- a simplified fuel injection system.

With reference now to FIG. 5, in the illustrated arrangement, air is introduced into the plenum chamber 88 through a pair of airbox inlet ports 92 and a filter 94. With reference to FIG. 6, the illustrated air induction system preferably also includes an idle speed control device (ISC) 96 that may be controlled by an Electronic Control Unit (ECU) 98 discussed in greater detail below.

In one advantageous arrangement, the ECU 98 is a microcomputer that includes a micro-controller having a CPU, a timer, RAM, and ROM. Of course, other suitable configurations of the ECU also can be used. Preferably, the ECU 98 is configured with or capable of accessing various maps to control engine operation in a suitable manner.

In general, the ISC device 96 comprises an air passage 100 that bypasses a throttle valve assembly 102. Air flow through the air passage 100 of the ISC device 96 preferably is controlled with a suitable valve 104, which may be a needle valve or the like. In this manner, the air flow amount can be controlled in accordance with a suitable control routine, one of which is discussed below.

Throttle bodies 106 slant downwardly toward the port side relative to the center axis of the engine 12. Respective top ends 108 of the throttle bodies 106, in turn, open upwardly within the plenum chamber 88. Air in the plenum chamber 88 thus is drawn through the throttle bodies 106, through individual intake passages 110 and the intake ports 80 into the combustion chambers 72 when negative pressure is generated in the combustion chambers 72. The negative pressure is generated when the pistons 68 move toward the bottom dead center position from the top dead center position during the intake stroke.

Figure 7:
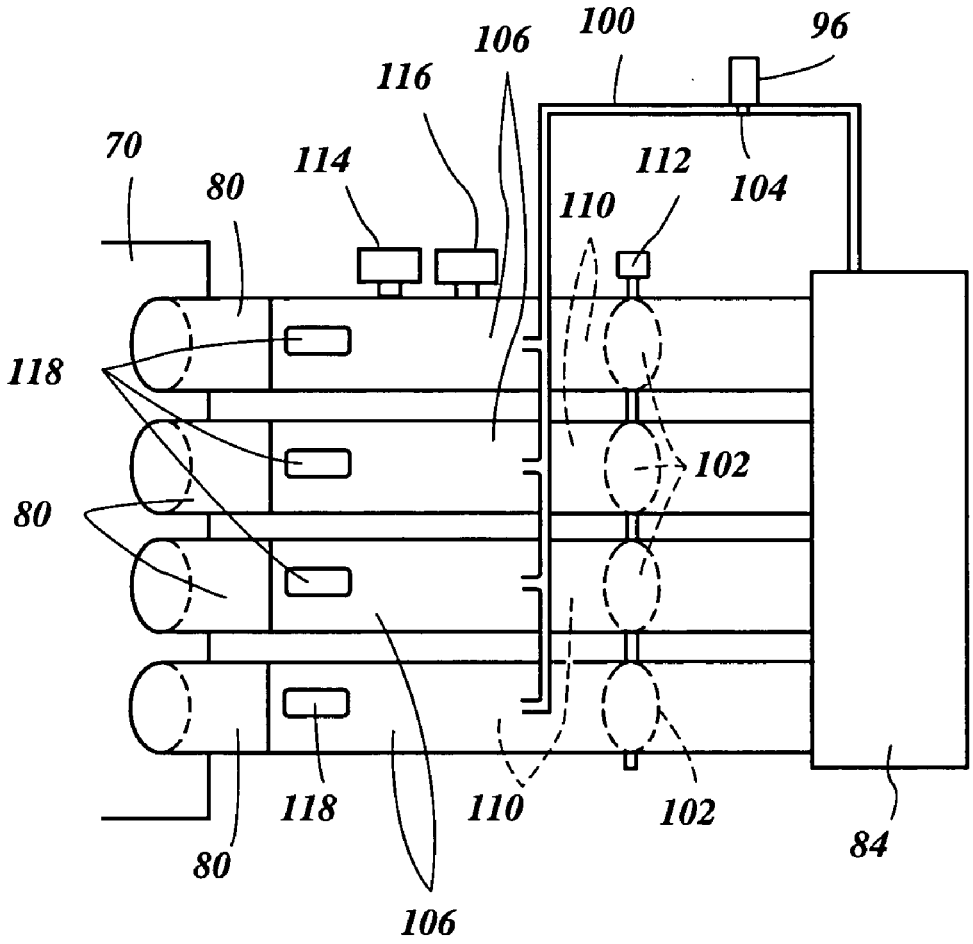
FIG. 7 is a cross-sectional view of the induction system of the engine. Portions of the intake manifold are illustrated partially in section.
Figure 7A:
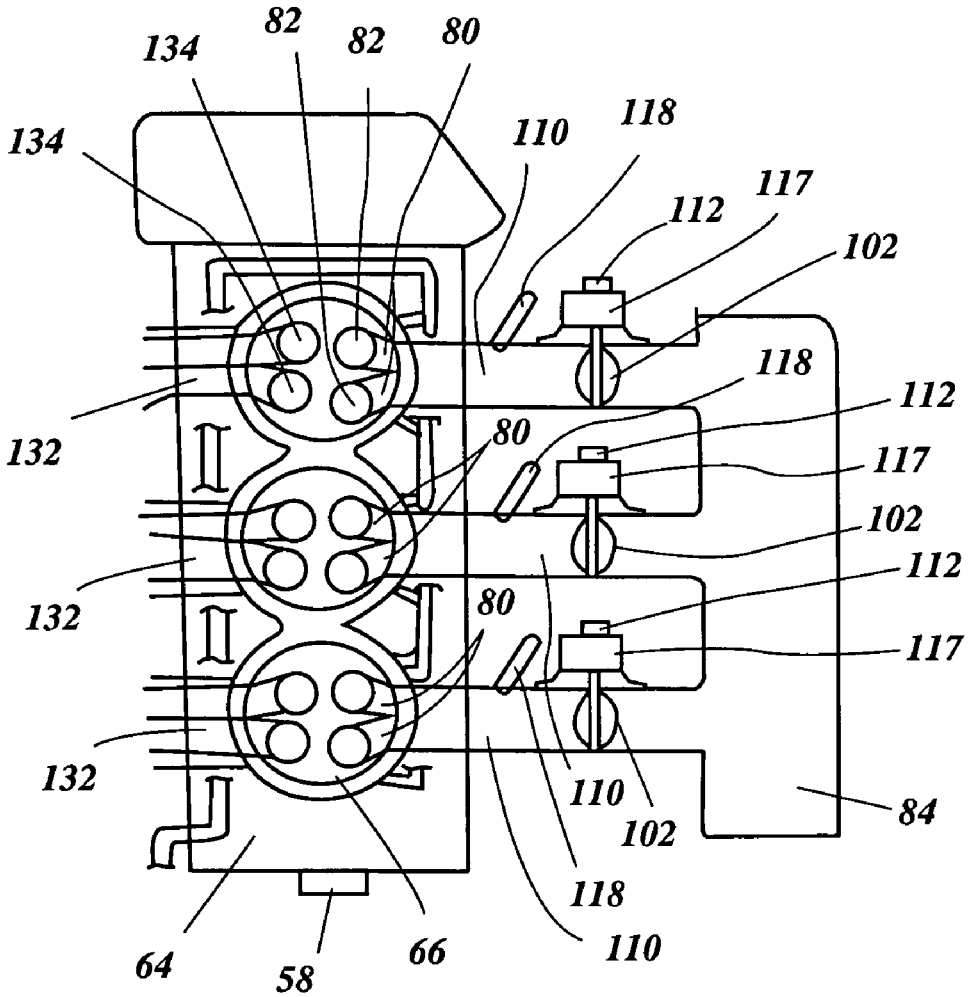
FIG. 7*a* is a cross-sectional view of a modification of the induction system of FIG. 7. Portions of the intake manifold are illustrated partially in section.

With reference to FIG. 7, a throttle valve position sensor 112 preferably is arranged proximate the throttle valve assembly 102 in the illustrated arrangement. The sensor 112 preferably generates a signal that is representative of either absolute throttle position or movement of the throttle shaft. Thus, the signal from the throttle valve position sensor 112 corresponds generally to the engine load, as may be indicated by the degree of throttle opening. In some applications, a manifold pressure sensor 114 can also be provided to detect engine load. Additionally, an induction air temperature sensor 116 can be provided to detect induction air temperature. The signal from the sensors 112, 114, 116 can be sent to the ECU 98 via respective data lines. These signals, along with other signals, can be used to control various aspects of engine operation, such as, for example, but without limitation, fuel injection amount, fuel injection timing, ignition timing, ISC valve positioning and the like.

Optionally, as shown in FIG. 7*a*, a plurality of electric throttle motors 117 can be arranged to operate the plurality of individual throttle assemblies 102, respectively. Thus, each electric throttle motor 117 can individually control the corresponding throttle valve assembly 102 allowing varying air charges to enter each combustion chamber 72. Throttle valve position sensors 112 preferably are arranged proximate each throttle valve assembly 102 in the illustrated arrangement. The sensors 112 preferably generate individual signals that are representative of either each individual absolute throttle position or movement of each individual throttle shaft. Thus, the signals from the throttle valve position sensors 112 correspond generally to individual cylinder load, as may be indicated by the degree of each throttle opening. These signals, along with other signals, can be used to control various aspects of engine operation through each cylinder individually. For example, but without limitation, each cylinders individual fuel injection amount, individual fuel injection timing, and individual ignition timing can be controlled.

The engine 12 also includes a fuel injection system which preferably includes four fuel injectors 118, each having an injection nozzle exposed to the intake ports 80 so that injected fuel is directed toward the combustion chambers 72. Thus, in the illustrated arrangement, the engine 12 features port fuel injection. It is anticipated that various features, aspects and advantages of at least one of the inventions disclosed herein also can be used with direct or other types of indirect fuel injection systems. In the modification of FIG. 7A, the engine 12 includes 3 fuel injectors 118.

With reference again to FIG. 6, fuel is drawn from the fuel tank 42 by a fuel pump 120, which is controlled by the ECU 98. The fuel is delivered to the fuel injectors 118 through a fuel delivery conduit 122. A fuel return conduit 124 also is provided between the fuel injectors 118 and the fuel tank 42. Excess fuel that is not injected by the fuel injector 118 returns to the fuel tank 42 through the conduit 124. The flow generated by the return of the unused fuel from the fuel injectors aids in cooling the fuel injectors.

In operation, a predetermined amount of fuel is sprayed into the intake ports 80 via the injection nozzles of the fuel injectors 118. The timing and duration of the fuel injection is dictated by the ECU 98 based upon any desired control strategy. In one presently preferred configuration, the amount of fuel injected is based upon the sensed throttle valve position and the sensed manifold pressure, depending on the state of engine operation. The fuel charge delivered by the fuel injectors 118 then enters the combustion chambers 72 with an air charge when the intake valves 82 open the intake ports 80.

The engine 12 further includes an ignition system. In the illustrated arrangement, four spark plugs 128 are fixed on the cylinder head member 70. The electrodes of the spark plugs 128 are exposed within the respective combustion chambers 72. The spark plugs 128 ignite an air/fuel charge just prior to, or during, each power stroke, preferably under the control of the ECU 98 to ignite the air/fuel charge therein.

The engine 12 further includes an exhaust system 130 to discharge burnt charges, i.e., exhaust gases, from the combustion chambers 72. In the illustrated arrangement, the exhaust system 130 includes four exhaust ports 132 that generally correspond to, and communicate with, the combustion chambers 72. The exhaust ports 132 preferably are defined in the cylinder head member 70. Exhaust valves 134 preferably are provided to selectively open and close the exhaust ports 132. A suitable exhaust cam arrangement, such as that described below, can be provided to operate the exhaust valves 134.

A combustion condition or oxygen sensor 136 preferably is provided to detect the in-cylinder combustion conditions by sensing the residual amount of oxygen in the combustion products at a point in time very close to when the exhaust port is opened. The signal from the oxygen sensor 136 preferably is delivered to the ECU 98. The oxygen sensor 136 can be disposed within the exhaust system at any suitable location. In the illustrated arrangement, the oxygen sensor 136 is disposed proximate the exhaust port 132 of a single cylinder. Of course, in some arrangements, the oxygen sensor can be positioned in a location further downstream; however, it is believed that more accurate readings result from positioning the oxygen sensor upstream of a merge location that combines the flow of several cylinders.

Figure 3:
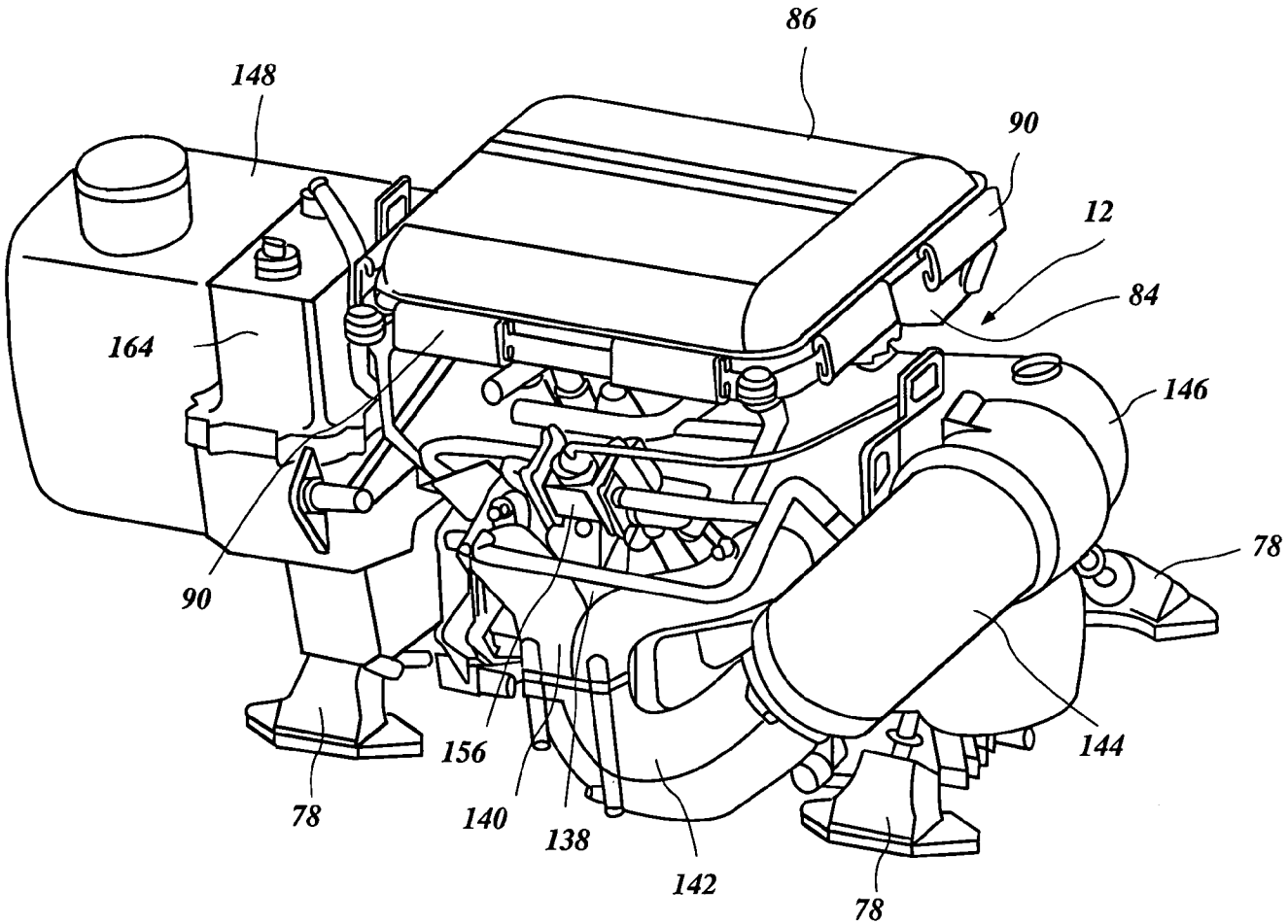
FIG. 3 is a front, starboard, and top perspective view of the engine removed from the watercraft illustrated in FIG. 1.

With reference now to FIG. 3, the illustrated exhaust system 130 preferably includes two small exhaust manifolds 138, 140 that each receive exhaust gases from a pair of exhaust ports 132 (i.e., a pair of cylinders). The respective downstream ends of the exhaust manifolds 138, 140 are coupled with a first unitary exhaust conduit 142. The first unitary conduit 142 is further coupled with a second unitary exhaust conduit 144. The second unitary conduit 144 is coupled with an exhaust pipe 146 at a location generally forward of the engine 12.

Figure 2:
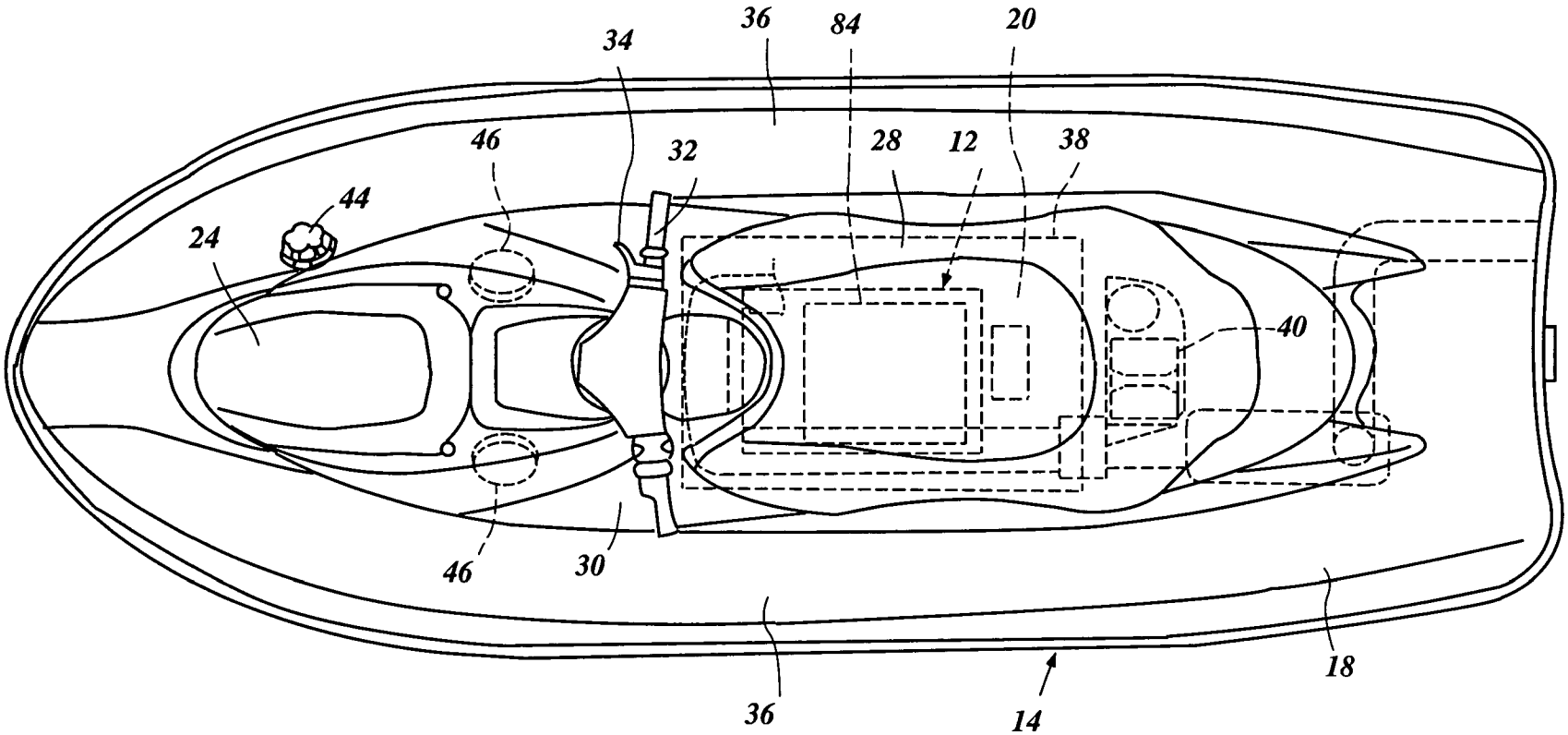
FIG. 2 is a top plan view of the watercraft of FIG. 1.

The exhaust pipe 146 extends rearwardly along a port side surface of the engine 12. The exhaust pipe 146 is connected to a water-lock 148 proximate a forward surface of the water-lock 148. With reference to FIG. 2, a discharge pipe 150 extends from a top surface of the water-lock 148. The discharge pipe 150 bends transversely across the center plane and rearwardly toward a stern of the watercraft. Preferably, the discharge pipe 150 opens at a stern of the lower hull section 16 in a submerged position. As is known, the water-lock 148 generally inhibits water in the discharge pipe 150 or the water-lock itself from entering the exhaust pipe 146.

The engine 12 further includes a cooling system configured to circulate coolant into thermal communication with at least one component within the watercraft 10. Preferably, the cooling system is an open-loop type of cooling system that circulates water drawn from the body of water in which the watercraft 10 is operating through thermal communication with heat generating components of the watercraft 10 and the engine 12. It is expected that other types of cooling systems can be used in some applications. For instance, in some applications, a closed-loop type liquid cooling system can be used to cool lubricant and other components.

The present cooling system preferably includes a water pump arranged to introduce water from the body of water surrounding the watercraft 10. The jet propulsion unit preferably is used as the water pump with a portion of the water pressurized by the impeller being drawn off for use in the cooling system, as is generally known in the art. Preferably, water jackets 152 can be provided around portions of the cylinder block 64 and the cylinder head member 70 (see FIG. 6).

In some applications, the exhaust system 130 is comprised of a number of double-walled components such that coolant can flow between the two walls (i.e., the inner and outer wall) while the exhaust gases flow within a lumen defined by the inner wall. Such constructions are well known.

An engine coolant temperature sensor 154 preferably is positioned to sense the temperature of the coolant circulating through the engine. Of course, the sensor 154 could be used to detect the temperature in other regions of the cooling system; however, by sensing the temperature proximate the cylinders of the engine, the temperature of the combustion chamber and the closely positioned portions of the induction system is more accurately reflected.

With reference again to FIG. 3, the engine 12 preferably includes a secondary air supply system that supplies air from the air induction system to the exhaust system 130. Hydrocarbon (HC) and carbon monoxide (CO) components of the exhaust gases can be removed by an oxidation reaction with oxygen (02) that is supplied to the exhaust system 130 from the air induction system. In one arrangement of the secondary air supply system, a secondary air supply device 156 is disposed next to the cylinder head member 70 on the starboard side. The air supply device 156 defines a generally closed cavity and contains a control valve in the illustrated arrangement. Air supplied from the air supply device 156 passes directly to the exhaust system 130 when the engine 12 is operating in a relatively high speed range and/or under a relatively high load condition because greater amounts of hydrocarbon (HC) and carbon monoxide (CO) are more likely to be present in the exhaust gases under such a condition.

With reference to FIGS. 5 and 6, the engine 12 preferably has a valve cam mechanism for actuating the intake and exhaust valves 82, 134. In the illustrated embodiment, a double overhead camshaft drive is employed. That is, an intake camshaft 158 actuates the intake valves 82 and an exhaust camshaft 160 separately actuates the exhaust valves 134. The intake camshaft 158 extends generally horizontally over the intake valves 82 from fore to aft, and the exhaust camshaft 160 extends generally horizontally over the exhaust valves 134 also from fore to aft.

Both the intake and exhaust camshafts 158, 160 are journaled in the cylinder head member 70 in any suitable manner. A cylinder head cover member 162 extends over the camshafts 158, 160, and is affixed to the cylinder head member 70 to define a camshaft chamber. The secondary air supply device 156 is preferably affixed to the cylinder head cover member 162. Additionally, the air supply device 156 is desirably disposed between the intake air box and the engine 12.

The intake camshaft 158 has cam lobes each associated with the respective intake valves 82, and the exhaust camshaft 160 also has cam lobes associated with respective exhaust valves 134. The intake and exhaust valves 82, 134 normally close the intake and exhaust ports 80, 132 by a biasing force of springs. When the intake and exhaust camshafts 158, 160 rotate, the cam lobes push the respective valves 82, 134 to open the respective ports 80, 132 by overcoming the biasing force of the spring. Air enters the combustion chambers 72 when the intake valves 82 open. In the same manner, the exhaust gases exit from the combustion chambers 72 when the exhaust valves 134 open.

The crankshaft 58 preferably drives the intake and exhaust camshafts 158, 160. The respective camshafts 158, 160 have driven sprockets affixed to ends thereof while the crankshaft 58 has a drive sprocket. Each driven sprocket has a diameter that is twice as large as a diameter of the drive sprocket. A timing chain or belt is wound around the drive and driven sprockets. When the crankshaft 58 rotates, the drive sprocket drives the driven sprockets via the timing chain, and thus the intake and exhaust camshafts 158, 160 also rotate.

Figure 4:
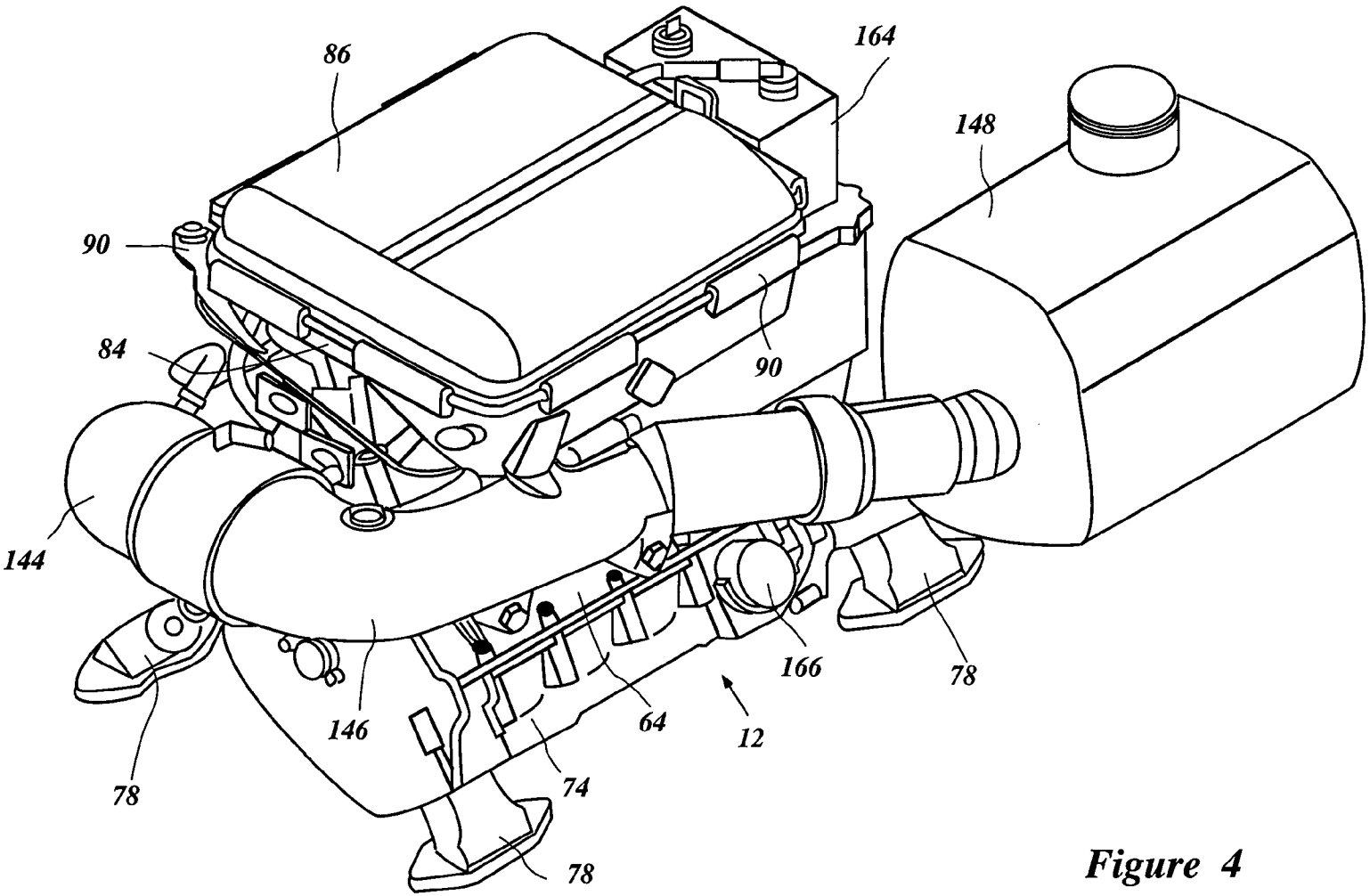
FIG. 4 is a front, port, and top perspective view of the engine removed from the watercraft illustrated in FIG. 1.

The engine 12 preferably includes a lubrication system that delivers lubricant oil to engine portions for inhibiting frictional wear of such portions. In the illustrated embodiment, a dry-sump lubrication system is employed. This system is a closed-loop type and includes an oil reservoir 164, as illustrated in FIGS. 3 and 4.

An oil delivery pump is provided within a circulation loop to deliver the oil in the reservoir 164 through an oil filter 166 to the engine portions that are to be lubricated, for example, but without limitation, the pistons 68 and the crankshaft bearings (not shown). The crankshaft 58 or one of the camshafts 158,160 preferably drives the delivery and return pumps.

In order to determine appropriate engine operation control scenarios, the ECU 98 preferably uses control maps and/or indices stored within the ECU 98 in combination with data collected from various input sensors. The ECU's various input sensors can include, but are not limited to, the throttle position sensor 112, the manifold pressure sensor 114, the engine coolant temperature sensor 154, the oxygen (02) sensor 136, and a crankshaft speed sensor 77.

It should be noted that the above-identified sensors merely correspond to some of the sensors that can be used for engine control and it is, of course, practicable to provide other sensors, such as an intake air pressure sensor, an intake air temperature sensor, a knock sensor, a neutral sensor, a watercraft pitch sensor, a shift position sensor and an atmospheric temperature sensor. The selected sensors can be provided for sensing engine running conditions, ambient conditions or other conditions of the engine 12 or associated watercraft 10.

During engine operation, ambient air enters the internal cavity 20 defined in the hull 14 through the air ducts 44. As seen in FIGS. 5, 6, 7, and 7*a* the air is then introduced into the plenum chamber 88 defined by the intake box 84 through the air inlet ports 92 and drawn into the throttle bodies 106. The air filter element 94, which preferably comprises a water-repellent element and an oil resistant element, filters the air. The majority of the air in the plenum chamber 88 is supplied to the combustion chambers 72. The throttle valves 102 in the throttle bodies 106 regulate an amount of the air permitted to pass to the combustion chambers 72. The rider can control the opening angles of the throttle valves 102, and thus, the airflow across the throttle valves 102, with the throttle lever 34. The air flows into the combustion chambers 72 when the intake valves 82 open. At the same time, the fuel injectors 118 spray fuel into the intake ports 80 under the control of ECU 98. Air/fuel charges are thus formed and delivered to the combustion chambers 72.

In another preferred embodiment of at least one of the inventions disclosed herein, the rider can request an engine torque to the ECU 98 by moving the throttle lever 34 thereby actuating a throttle lever position sensor (not shown), which can be in the form of, for example, but without limitation, a potentiometer, rheostat, linear transducer, and the like. The ECU 98 can then control the throttle valve opening angles through the electric throttle motors 117 as well as fuel injection duration and fuel injection timing based on the rider's engine torque request. The amount of air flow, the fuel injection duration, and the fuel injection timing can be individually controlled for each cylinder.

The air/fuel charges are fired by the spark plugs 128 under the control of the ECU 98. The burnt charges, i.e., exhaust gases, are discharged to the body of water surrounding the watercraft 10 through the exhaust system 130. A relatively small amount of the air in the plenum chamber 88 is supplied to the exhaust system 130 so as to aid in further combustion of any unburned fuel remaining in the exhaust gases.

The combustion of the air/fuel charges causes the pistons 68 to reciprocate and thus causes the crankshaft 58 to rotate. The crankshaft 58 drives the impeller shaft 56 and the impeller rotates in the hull tunnel 50. Water is thus drawn into the tunnel 50 through the inlet port 52 and then is discharged rearward through the steering nozzle 62. The rider steers the nozzle 62 by the steering handle bar 32. The watercraft 10 thus moves as the rider desires.

Figure 8:
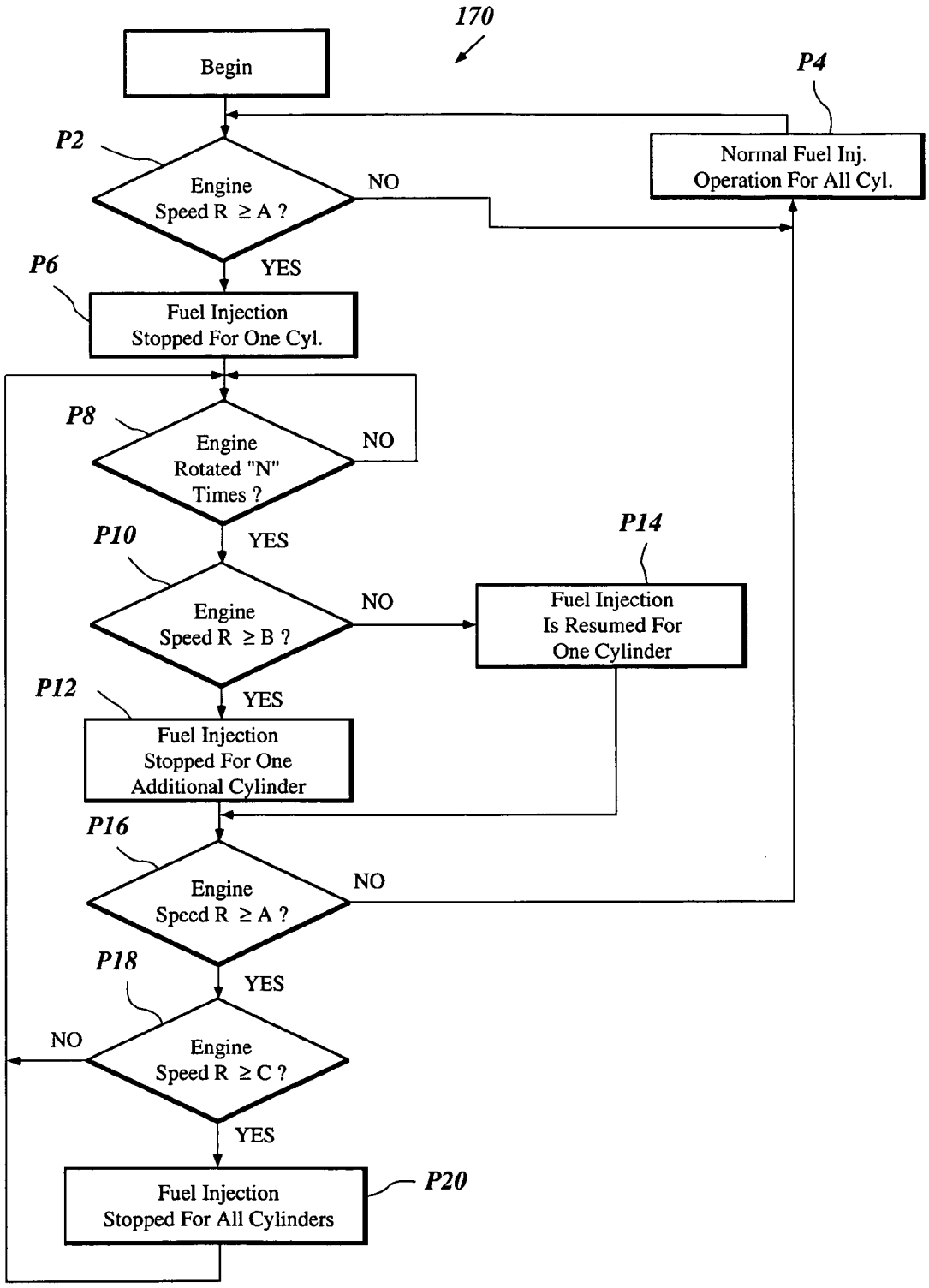
FIG. 8 is a block diagram showing a control routine arranged and configured in accordance with certain features, aspects and advantages of at least one of the inventions disclosed herein.

With reference to FIG. 8, a control arrangement is shown that is arranged and configured in accordance with certain features, aspects and advantages of at least one of the inventions disclosed herein. The control routine 170 is configured to control operation of the fuel injection based on engine speed to prevent over-revving engine damage. As shown in FIG. 8, the control routine begins and moves to a first decision block P2. In the illustrated embodiment, the routine 170 can start as soon as a rider attempts to start the engine 12, for example as soon as the start button is activated. However, it is to be understood that the routine 170 can start at any time.

In decision block P2, the engine speed R is compared to a predetermined initial engine speed A. Preferably, the predetermined initial engine speed A is an engine speed that is higher than an engine speed that corresponds to a steady-state full-throttle/top speed operation where the intake duct of the jet propulsion unit is completely submerged. If the engine speed R is determined to be not greater than or equal to speed A, the program moves to the operation block P4.

In the operation block P4, normal fuel injection operation is established for all cylinders of engine 12. Preferably, the control routine 170 returns to the beginning and repeats as long as the engine is running.

If however, at the operation block P2, the sensed engine speed R is not greater than or equal to A, the control routine 170 moves to operation block P6 where the fuel injection is stopped for a single cylinder, thereby disabling that cylinder. Stopping fuel injection for a single cylinder reduces the total power output of the engine 12 by a first degree. In other words, the power output of the engine is reduced to a first state of reduced power output. Under certain conditions, such a reduction in power output will result in a reduction in engine speed. However, under other conditions, discussed in greater detail below, the engine speed may not fall.

After the operation block P6, the control routine 170 then proceeds to a decision block P8 where it is determined if the engine has rotated N times (N corresponding to the number of revolutions needed to complete a combustion cycle, for a four cycle, N=2). If the engine has not rotated N times then the control routine 170 returns to P8 until the number of engine revolutions N is achieved.

If however, at the decision block P8, the engine has rotated N times, the control routine 170 moves to decision block P10 where it determines if the engine speed R is greater than or equal to B. The second predetermined engine speed B is an engine speed that is higher than engine speed A.

If, at decision block P10, it is determined that the engine speed R is greater than or equal to the predetermined engine speed B, the control routine 170 moves to operation block P12 where the fuel injection is stopped for an additional cylinder. Stopping the fuel injection for an additional cylinder will further reduce the total power output of the engine 12, by a second degree. In other words, the power output of the engine is reduced to a second state of reduced power. Under certain conditions, such a further reduction in power output can cause the engine speed R to fall. However, under other conditions, discussed in greater detail below, the engine speed R may not fall. The control routine 170 then moves to decision block P16.

If however, in decision block P10, it is determined that the engine speed R is not greater than or equal to a second predetermined engine speed B, the control routine 170 moves to operation block P14.

At the operation block P14, the control routine 170 resumes fuel injection to the cylinder disabled at the operation block P6. Thus, the power output of the engine 12 is increased by a degree. In other words, the power output of the engine 12 is restored or increased by the first degree, back to the normal power output. After the operation block P14, the control routine 170 moves to the decision block P16.

In decision block P16, the control routine 170 again determines if an engine speed R is greater than or equal to the first predetermined engine speed A. If the engine speed R is not greater than or equal to the first predetermined engine speed A, the control routine 170 moves to operation block P4 where normal fuel injection operation is resumed for all cylinders.

If however, in decision block P16, the engine speed R is greater than or equal to the first predetermined engine speed A, the control routine 170 moves to decision block P18 where the engine speed R is compared to a third predetermined engine speed C, which is higher than the first and second predetermined engine speeds.

If in the decision block P18 the engine speed R is found to be greater or equal to the third predetermined engine speed C the control routine 170 moves to operation block P20 where the fuel injection is stopped for all cylinders. Stopping the fuel injection for all cylinders lowers the engine speed under any condition the watercraft 10 is likely to experience in operation.

If however, in decision block P18 the engine speed R is not greater than or equal to the third predetermined engine speed, the control routine 170 moves to decision block P8 and repeats.

Figure 9:
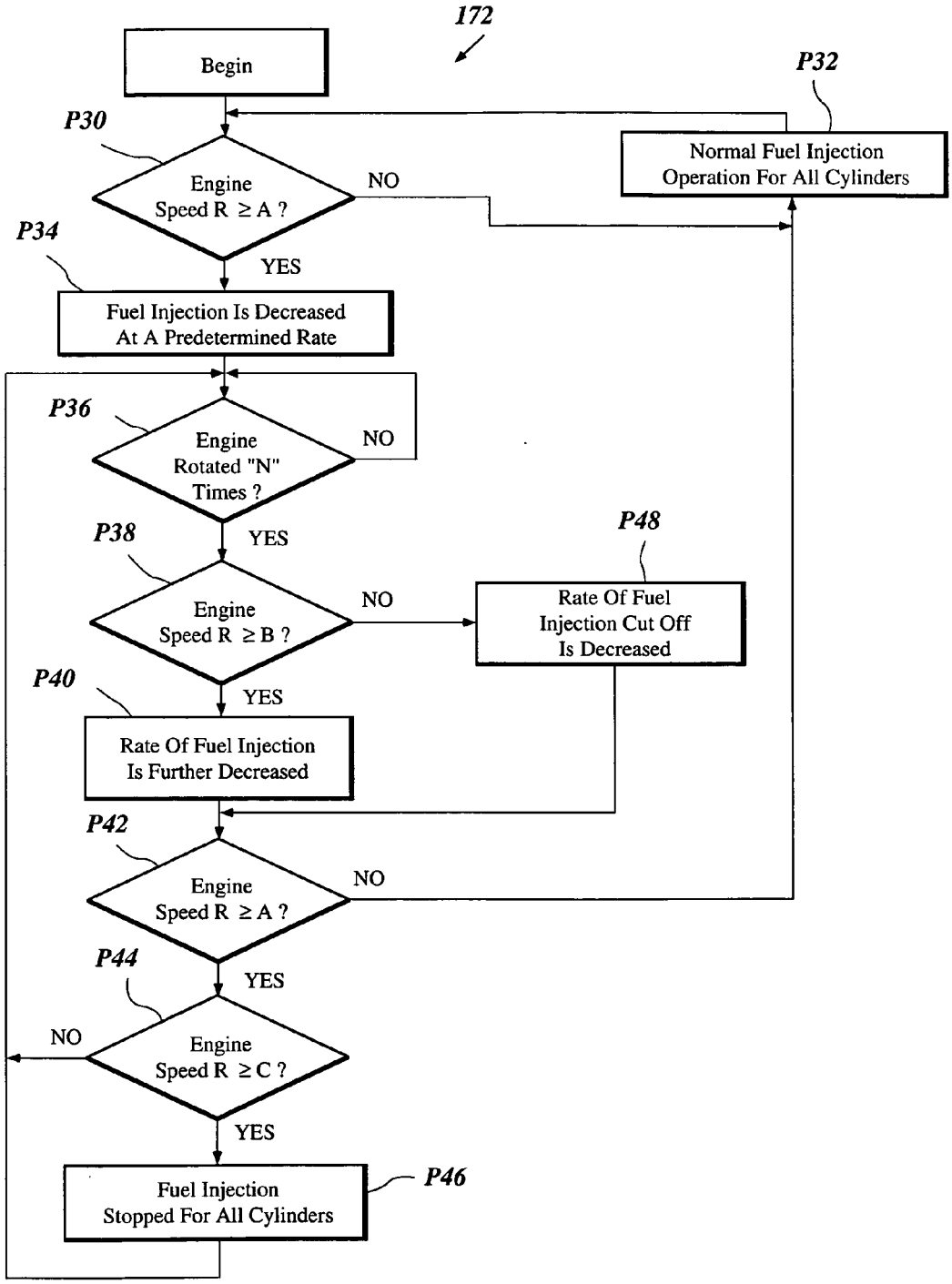
FIG. 9 is a block diagram showing another control routine arranged and configured in accordance with certain features, aspects and advantages of at least one of the inventions disclosed herein.

With reference now to FIG. 9, a modification of the control routine 170 is shown therein and referred to by the reference numeral 172. The control routine 172 is configured to control operation of the fuel injection based on engine speed. As shown in FIG. 9, the control routine begins and moves to a first decision block P30. In the illustrated embodiment, the routine 172 can start as soon as a rider attempts to start the engine 12, for example as soon as the start button is activated. However, it is to be understood that the routine 172 can start at any time.

In decision block P30, the engine speed R is compared to the first predetermined engine speed A. If the engine speed R is not greater than or equal to speed A, the program moves to the operation block P32.

In the operation block P32, normal fuel injection operation is continued or reestablished for all cylinders of engine 12. Preferably, the control routine 172 returns to the beginning and repeats as long as the engine is running.

If however in the decision block P30, the sensed engine speed R is not greater than or equal to A, the control routine 172 moves to operation block P34 where the fuel injection for all cylinders is decreased at a predetermined rate. For example, the control routine 172 can decrease the fuel injection to all of the cylinders by 20%. i.e., for five fuel injection cycles, one is skipped. This method of reducing fuel injection is explained below in greater detail with reference to FIGS. 11*a* and 11*b*. Under certain conditions, reducing fuel injection as such will cause the engine speed R to fall. However, under other conditions, discussed below in greater detail, the engine speed R may not fall. After the operation block P34, the control routine 170 moves to a decision block P36.

At the decision block P36 it is determined if the engine has rotated N times (N corresponding to the number of revolutions needed to complete a combustion cycle, e.g. for a four cycle engine, N=2). If the engine has not rotated N times then the control routine 172 returns to P36 until the number of engine revolutions N is achieved.

If however, the engine has rotated N times, the control routine 172 moves to decision block P38 where it determines if the engine speed R is greater than or equal to the second predetermined engine speed B. If it is determined that the engine speed R is greater than or equal to the predetermined engine speed B, the control routine 172 moves to an operation block P40.

At the operation block P40, the fuel injection is further decreased for all cylinders by a predetermined rate. For example, the control routine 172 can further decrease the fuel injection for all of the cylinders by an additional 20%, resulting in a 40% reduction in fuel injection relative to the normal fuel injection scenario. After the operation block P40, the control routine 172 then moves to a decision block P42.

If however, in decision block P38 it is determined that the engine speed R is not greater than or equal to a second predetermined engine speed B, the control routine 172 moves to operation block P48, where the rate of fuel injection cutoff is decreased. For example, if the fuel injection had been decreased by 20% in operation block P34, fuel injection can be increased by 20%. The control routine then moves to decision block P42.

In the decision block P42, the control routine 172 again determines if an engine speed R is greater than or equal to the first predetermined engine speed A. In decision block P42, if the engine speed R is not greater than or equal to the first predetermined engine speed A, the control routine 172 moves to operation block P32 where normal fuel injection operation is established for all cylinders.

If however, in decision block P42, the engine speed R is greater than or equal to the first predetermined engine speed A, the control routine 172 moves to decision block P44 where the engine speed R is compared to the third predetermined engine speed C.

If, in the decision block P44, the engine speed R is found to be greater or equal to the third predetermined engine speed C the control routine 172 moves to operation block P46 where the fuel injection is stopped for all cylinders. Stopping the fuel injection for all cylinders lowers the engine speed in any condition in which the watercraft 10 is likely to be operated.

If however, in decision block P44 the engine speed R is not greater than or equal to the third predetermined engine speed threshold the control routine moves to decision block P36 and continues to repeat the control routine steps.

It is to be noted that the control systems described above may be in the form of a hard-wired feedback control circuit in some configurations. Alternatively, the control systems may be constructed of a dedicated processor and memory for storing a computer program configured to perform the steps described above in the context of the flowcharts. Additionally, the control systems may be constructed of a general purpose computer having a general purpose processor and memory for storing the computer program for performing the routines. Preferably, however, the control systems are incorporated into the ECU 98, in any of the above-mentioned forms.

Figure 10A:
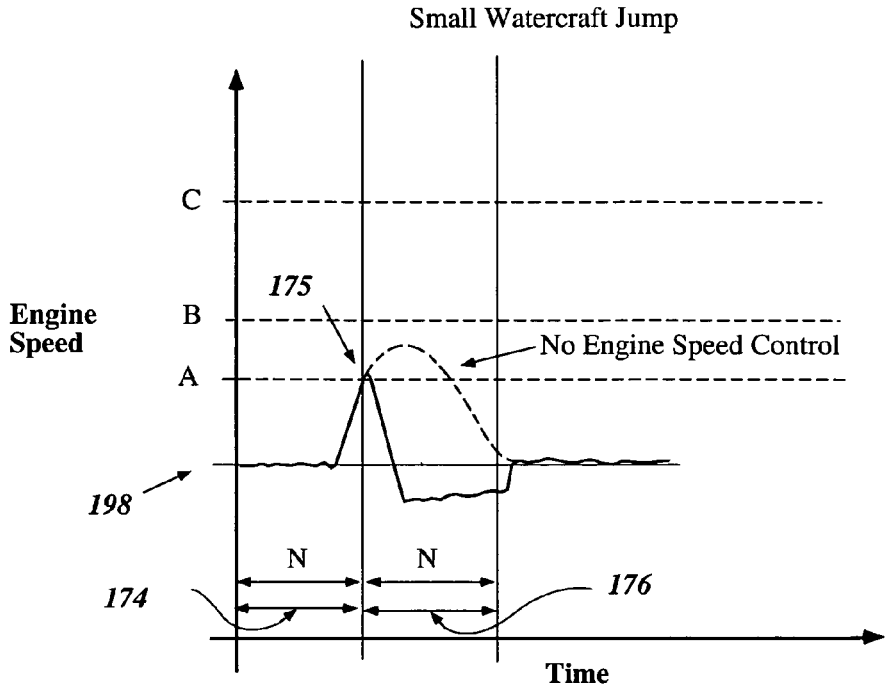
FIG. 10*a* is a diagram of a graph illustrating engine speed characteristics during a small jump out of the water of a watercraft.
Figure 10B:
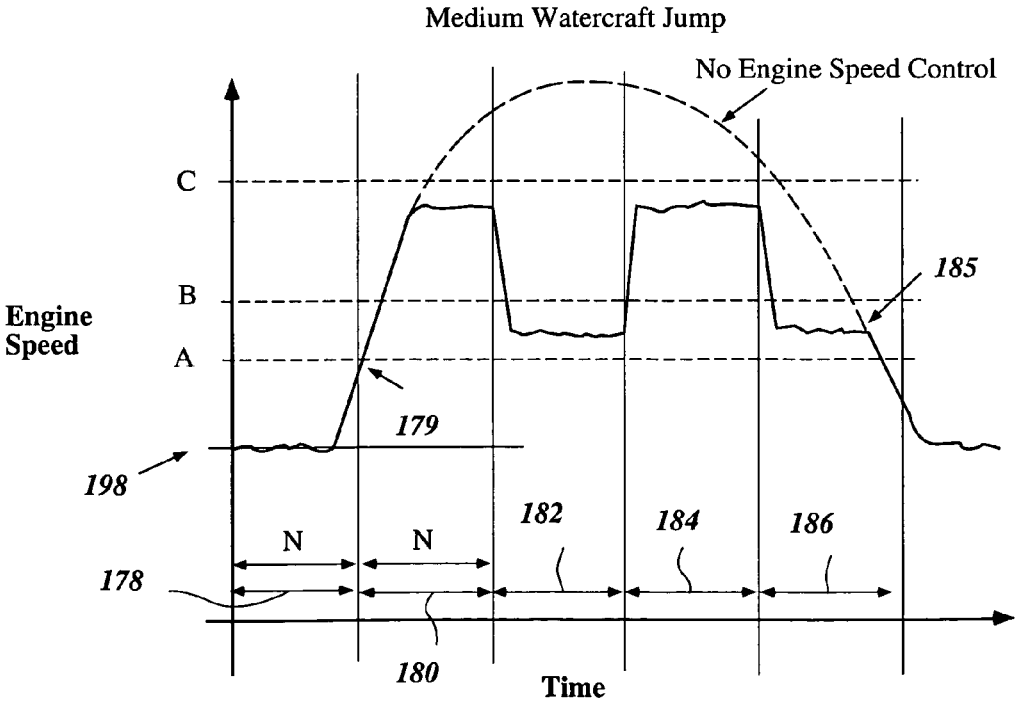
FIG. 10*b* is a diagram of a graph illustrating engine speed characteristics during a medium jump out of the water of a watercraft.
Figure 10C:
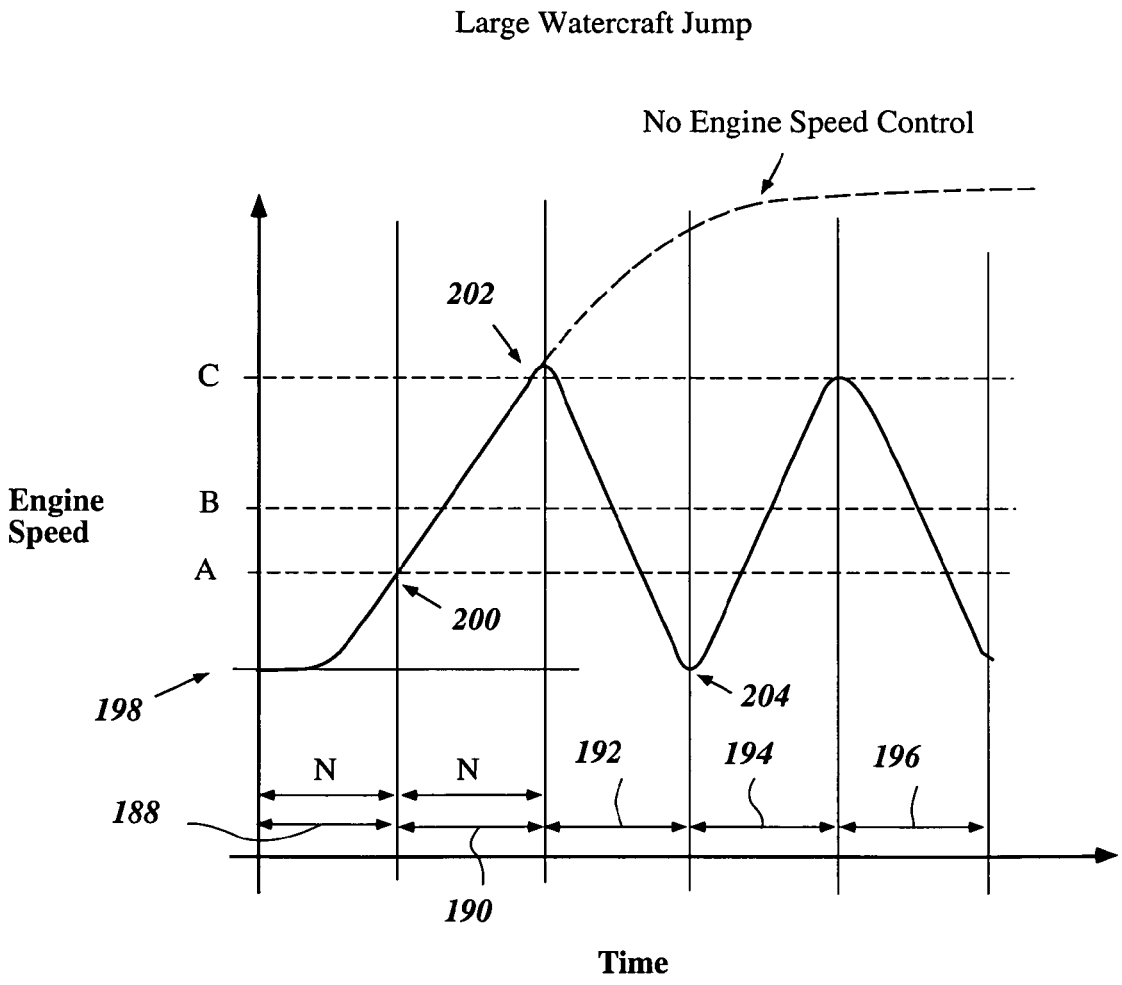
FIG. 10*c* is a diagram of a graph illustrating engine speed characteristics during a large jump out of the water of a watercraft.

With reference to FIGS. 10*a*, 10*b*, and 10*c*, graphs illustrating engine speed characteristics during various operational conditions of the watercraft 10. In particular, FIGS. 10*a*, 10*b*, and 10*c* illustrate a relationship between engine speed (vertical axis) and time (horizontal axis) when the watercraft jumps out of the water sufficiently to cause air to be drawn into the jet pump. In each figure, a solid line represents the behavior of the engine 12 during a small jump (FIG. 10*a*), a medium jump (FIG. 10*b*), and a large jump (FIG. 10*c*). Additionally, each of these figures includes a dashed line representing the theoretical behavior of a watercraft engine with no rev-limiter.

In the FIGS. 10*a*, 10*b*, and 10*c*, a steady state, constant, full throttle engine speed 198 is illustrated. At this steady state engine speed the jet pump unit 48 is experiencing a consistent load. However this engine speed 198 is not the highest allowable engine speed. At an engine speed range above the steady state engine speed 198, at least one of the inventions disclosed herein is designed to limit higher engine speeds in proportion to a magnitude in reduction of load, such as that caused when the watercraft jumps partially or completely out of the water.

Three predetermined engine speeds, A, B, and C are used to as reference so as to create a proportional rev-limiting response in order to maintain a smooth ride. The first predetermined engine speed A represents an engine speed that is slightly higher than the optimal engine speed 198. At the detection of the first predetermined engine speed A the control system starts to limit the engine speed. A second predetermined engine speed B is slightly above the first predetermined engine speed A. A third predetermined engine speed C represents an engine speed that can be too high for the engine to operate properly. The predetermined engine speed C corresponds to an engine speed in which the control system can rapidly lower the engine speed to an engine speed where the engine operates more efficiently.

With reference to FIG. 10*a* and the control routines 170 and 172, the engine speed of the watercraft 10 during a small jump with reference to time is shown. In time increment 174, an engine speed increase is shown approaching the first predetermined engine speed A. With reference to P2 and P30, when the engine speed reaches the first predetermined engine speed A at a point 175, the power output of the engine is lowered. Under this condition, where only a small amount of air enter the jet pump unit 48, reducing the power output of the engine 12 to the first reduced output state is sufficient to cause the engine speed to drop below the speed A. In time increment 176, a controlled engine speed decrease can by seen where the engine speed is initially brought down for a period of time N, which corresponds to the operation performed in the operation block P8, and then resumes to optimal operating speed.

With reference to FIG. 10*b* and the control routines 170 and 172, the engine speed of the watercraft during a medium jump with reference to time is shown. In time increment 178, an initial engine speed increase can be seen. As seen in time increment 180, this speed increase reaches above the first predetermined speed A at point 179. Thus, as dictated by operation block P6 and P34, the power output of the engine 12 is initially reduced. However, because of the size of this jump, and the accompanying drop in load on the engine, the engine speed does not stop increasing until it reaches a speed between the predetermined speeds B and C.

At the end of the time period 180, after the engine has rotated N times, it is determined that the engine speed is above speed B. Thus, as dictated by the operation blocks P12 and P40, the power output of the engine 12 is further reduced, i.e., reduced to a second state of reduced power, such as for example but without limitation, two cylinders disabled or fuel injection reduced by 40%. As represented in FIG. 10*b*, this power reduction is sufficient to cause the engine speed to fall. As illustrated at the beginning of the time period 182, the engine speed falls to a speed between the speeds A and B.

At the end of the time period 182, the routines 170, 172 then return to the decision blocks P10 and P38 respectively. Because the engine speed is below speed B, power output is increased by a degree. In this case, the power output is restored to the first state of reduced power output, for example but without limitation, only one cylinder disabled or fuel injection reduced by 20%. Thus, due to the magnitude of this jump, the engine speed rises to speed between the speeds B and C.

As the routines 170, 172 repeat, the engine 12 is allowed to operate at a speed above the speed A. Thus, as the jet pump unit is re-loaded, the engine speed does not drop abruptly. As noted above, abrupt drops in engine speed can make the operator and passengers uncomfortable.

FIG. 10*c* illustrates the behavior of the control routines 170 and 172 and their affect on the engine speed of the watercraft during a large jump. During time increments 188, 190, 192, 194, 196, the engine speed fluctuates due to a prolonged lack of engine load by the absence of water in the jet pump unit 48.

For example, as the engine speed rises above speed A, at the end of time period 188 (point 200), the control routines 170, 172 reduce power output at operation blocks P6 and P34, respectively. However, due to the magnitude of this jump, the engine speed does not fall. By the time the engine speed is sensed again at decision blocks P10 and P38, after the time delay produced by decision blocks P8 and P36 (the end of time period 190), the engine speed has already exceeded speed C (point 202). Thus, the routines quickly reach operation blocks P20 and P46, cutting off all power.

Because the engine speed is considerable, the engine continues to rotate as it slows. As the routines reach decision block P16 and 942, respectively, the engine speed falls to a speed below speed A (point 204). Thus, normal fuel injection, and thus, full power output are restored (operation blocks P4, P32). However, because the jet pump unit 46 is not loaded, the cycle repeats until the jet pump unit 46 is re-loaded.

Figure 11A:
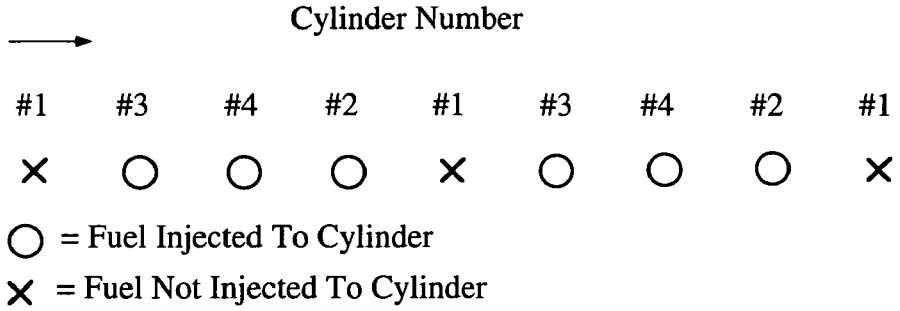
FIG. 11*a* is a diagram illustrating a procedure for a fuel injection cut-off sequence arranged and configured in accordance with certain features, aspects and advantages of at least one of the inventions disclosed herein.
Figure 11B:
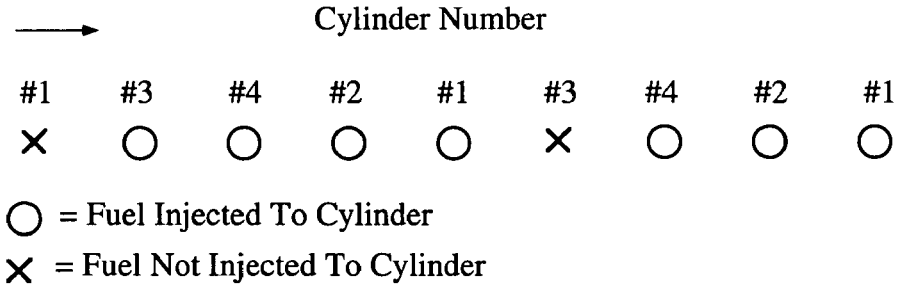
FIG. 11*b* is a diagram illustrating another procedure for a fuel injection cut-off sequence arranged and configured in accordance with certain features, aspects and advantages of at least one of the inventions disclosed herein.

With reference to FIGS. 11*a* and 11*b*, procedures for a fuel injection cut-off sequence are shown. Both procedures represent ways to regulate a fuel injection cut-off sequence, which preserves a smooth-feeling operation for the watercraft operator. As shown in FIG. 11*a*, a fuel injection sequence follows from left to right. Numbers represent which cylinder into which the fuel is being injected. A zero indicates that a normal fuel injection cycle is performed for the corresponding cylinder, and an X represents fuel injection cut-off for that cylinder. FIG. 11*a* shows a fuel injection cut-off sequence where the same cylinder is being repeatedly deprived of fuel. As such, FIG. 11*a* corresponds to fuel injection being cut-off for one cylinder of the engine 12.

Such a reduction of fuel injection can also be expressed as a percentage. For example, when fuel injection to one cylinder is stopped in a four cylinder engine, one fuel injection cycle is skipped for every four fuel injection cycles of the normal mode. Thus, in the scenario illustrated in FIG. 11*a*, fuel injection has been reduced by 25%.

As shown in FIG. 11*b*, a fuel injection sequence again follows from left to right. Numbers represent which cylinder into which the fuel is being injected. A zero indicates that a normal fuel injection cycle is performed for the corresponding cylinder, and an X represents fuel injection cut-off for that cylinder. FIG. 11*b* shows a fuel injection cut-off sequence where each cylinder is being sequentially deprived of fuel. As such, FIG. 11*b* corresponds to fuel injection being cut-off for one cylinder per fuel injection cycle of the engine 12 in an alternating sequence.

Such a reduction of fuel injection can also be expressed as a percentage. For example, when fuel injection to one cylinder per fuel injection cycle is stopped in an alternating sequence in a four cylinder engine, one fuel injection cycle is skipped for every five fuel injection cycles of the normal mode. Thus, in the scenario illustrated in FIG. 11*b*, fuel injection has been reduced by 20%. An alternating sequential fuel injection cut off prevents damage associated with repeated cylinder disablement.

Figure 12:
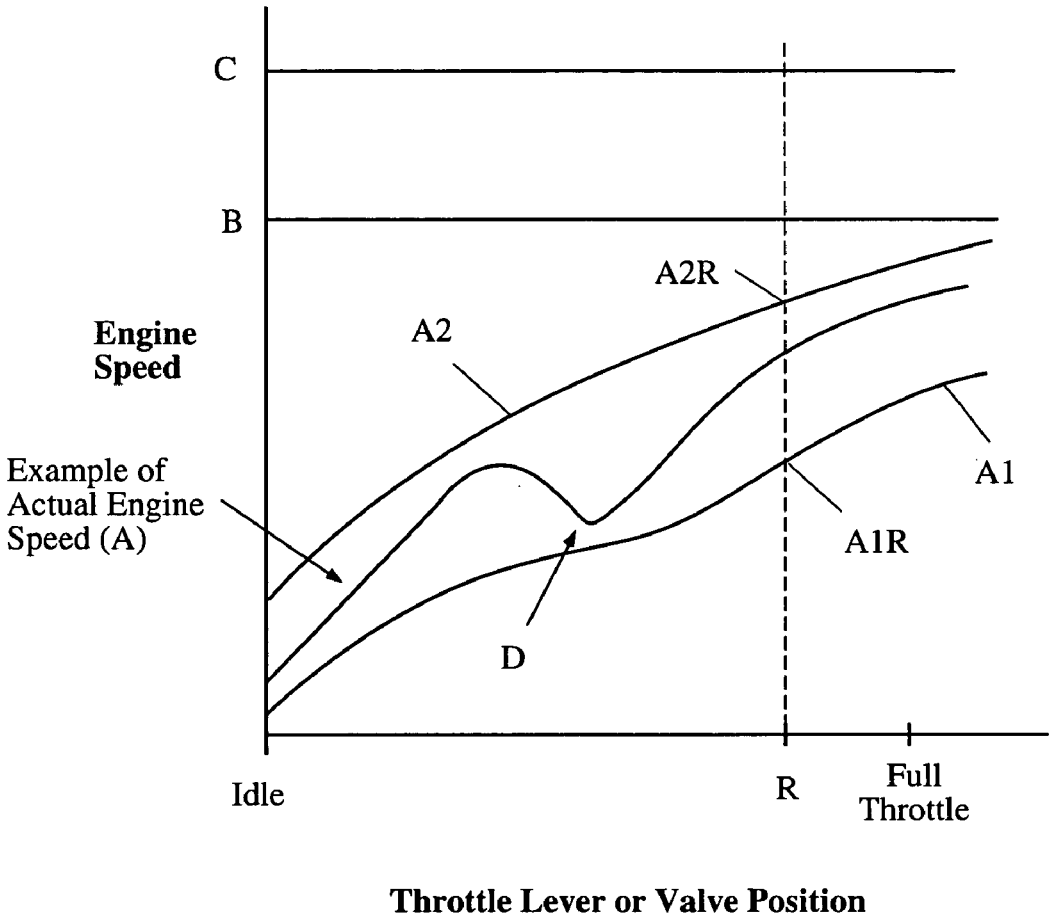
FIG. 12 is a diagram illustrating an engine speed range with reference to throttle valve position.

FIG. 12 includes a graph with engine speed A on the vertical axis and throttle valve position on the horizontal axis. A reference engine speed range is identified on the graph as being bounded by the curves A1 and A2. An exemplary actual engine speed curve A is also included in the graph and identified as such. The actual engine speed curve A represents the steady-state engine speed resulting from the corresponding throttle valve position. It is to be noted that the illustrated actual engine speed curve A generally represents an acceleration of a watercraft, such as the watercraft 10, from an idle state to a planing state. At approximately the center of the graph, there is a dip D in the actual engine speed curve. The dip D is a result of the change in engine load caused when such a watercraft transitions from a displacement mode to a planing mode.

Advantageously, the reference engine speed range A1–A2 is used as a reference to control the engine speed A when the watercraft 10 leaves the water. For example, as the watercraft 10 leaves the water during a jump, the predetermined engine speed range A1–A2 is determined based on the throttle valve position or on the throttle lever position, and the rev-limiting functions of the ECU 98 are actuated to adjust the actual engine speed A to the engine speed range A1–A2. Thus, for example, prior to a watercraft jump, the actual speed A of the engine would normally be between A1 and A2 for a given throttle valve or throttle lever position. When the watercraft leaves the water, and air enters the jet pump, the load on the engine drops quickly, causing the engine speed A to rise rapidly. In this situation, the actual engine speed A would normally rise above the upper engine speed A2. If the watercraft returned to the water with the engine speed A above the speed A2, the rider might experience an uncomfortable pulling on the rider, at least initially, caused by the excessive engine speed. A similar effect can be caused if the engine speed A is below A1, resulting in an uncomfortable pushing on the rider.

However, by using the speed range A1–A2 as a reference, the ECU 98 can reduce or eliminate the uncomfortable feeling. For example, the ECU 98 can be configured to reduce the engine speed A when the watercraft leaves the water, to maintain the engine speed in the range A1–A2. Thus, the engine speed A when the watercraft returns to the water will be matched to the engine speed A when the watercraft leaves the water. As such, the uncomfortable feeling that might otherwise be experienced by the rider will be reduced or eliminated. Thus, the calculated A1–A2 engine speed range provides for a comfortable landing and a more enjoyable watercraft experience. The reference engine speed range (A1–A2) data for a particular watercraft can be determined through routine experimentation.

FIG. 12 also illustrates a maximum allowable engine speed B as well as an engine speed range C that is above all allowable engine operating speeds. Various control routines are described below that incorporate the various engine speed ranges and limits.

Figure 13:
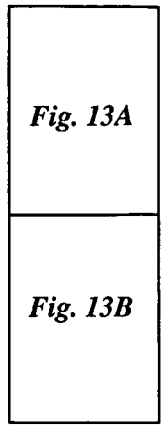
FIG. 13 is a block diagram showing another control routine arranged and configured in accordance with certain features, aspects and advantages of at least one of the inventions disclosed herein.

With reference to FIG. 13, a control arrangement is shown that is arranged and configured in accordance with certain features, aspects and advantages of at least one of the inventions disclosed herein. The control routine 210 is configured to control operation of the fuel injection based on engine speed to prevent over-revving engine damage. As shown in FIG. 13, the control routine begins and moves to a first decision block P50. In the illustrated embodiment, the routine 210 can start as soon as a rider attempts to start the engine 12, for example as soon as the start button is activated. However, it is to be understood that the routine 210 can start at any time.

In operation block P50 a throttle opening angle $\beta$ is calculated through a rider's torque request represented by the position of the throttle lever 34. A corresponding fuel injection amount a is calculated based on at least the value $\beta$. The control routine 210 then moves to decision block P52.

In decision block P52, it is determined if an engine stop signal is present. If an engine stop signal is present, the control routine moves to operation block P54 where the fuel and/or ignition are stopped.

If, however in decision block P52, the control routine determines that an engine stop signal is not present, the control routine 210 proceeds to decision block P56 where the engine speed R is compared to the predetermined reference engine speed B. Preferably, the predetermined reference engine speed B is an engine speed that is higher than an engine speed that corresponds to a steady-state full-throttle/top speed operation where the intake duct of the jet propulsion unit is completely submerged. If the engine speed R is determined to be not greater than or equal to speed B, the control routine 210 returns to the beginning and repeats as long as the engine is running.

If, however, in decision block P56 the sensed engine speed R is greater than or equal to B, then the control routine proceeds to an operation block P58 where $\beta$ is reduced by a value $\Delta\beta$. Preferably $\Delta\beta$ is a predetermined value of throttle position corresponding to an particular engine speed, i.e. a predetermined engine speed value. The control routine 210 then proceeds to a decision block P60.

In decision block P60, it is determined if the watercraft is airborne. Determining if the watercraft has temporarily left the water, i.e. airborne, can be accomplished through various systems. For example, these systems include but are not limited to, pressure sensors mounted on the lower hull 16 of the watercraft 10, sensors mounted in the vicinity of the jet pump inlet port 52, and/or in the vicinity of the jet pump tunnel 50. Other possibilities for determining if the watercraft 12 is airborne include monitoring the engine speed and determining if a sudden increase or an abnormal increase in engine speed becomes apparent. If it is determined that the watercraft is not airborne, the control routine 210 preferably returns to the beginning and repeats as long as the engine is running.

If, however, in decision block P60 it is determined that the watercraft is airborne, the control routine 210 proceeds to a decision block P62 where it is determined if the engine has rotated N times (N corresponding to the number of revolutions needed to complete a combustion cycle, for a four cycle engine, N=2). If the engine has not rotated N times then the control routine 210 returns to decision block P60 until the number of engine revolutions N is achieved.

If however, at the decision block 62, the engine has rotated N times, the control routine 210 moves to operation block P64 (FIG. 13B) where a reference engine speed range A1–A2 is determined. For example, but without limitation, the engine speed range A1–A2 illustrated in FIG. 12 is correlated to throttle lever positions. Thus, in the block P64, the control routine 210 can sample the signal from the throttle lever position sensor and compare the position to the engine speed reference data, an example of which is shown in FIG. 12. The engine speed range A1–A2 is determined to be that which is correlated to the sensed throttle lever position sensor. For example, if the throttle lever position is R, the reference engine speed range is A1R–A2R.

During a jump, a rider might not move the throttle lever 34, indicating that the rider is satisfied with the speed of the watercraft, and does not wish a speed change when the watercraft lands. However, the rider might release the throttle lever 34 partially or completely. As such, it can be assumed that the rider wishes to slow the watercraft upon landing. On the other hand, the rider might squeeze the throttle lever 34 further, thereby indicating that the watercraft should be accelerated upon landing. Thus, by determining the reference engine speed range A1R–A2R after the beginning of the jump, the further advantage is achieved in that the rider can choose any of these options.

The control routine 210 proceeds to decision block P66 where it is determined if an engine speed R is less than or equal to the engine speed A1. If the engine speed R is not less than or equal to the engine speed A1, the control routine 210 proceeds to a decision block P72.

If, however, in decision block P66 the engine speed R is less than or equal to the engine speed A1, the control routine 210 proceeds to an operation block P68 where a timer is reset. The control routine proceeds to an operation block P70.

In the operation block P70, the throttle position value $\beta$ is increased by a predetermined value $\Delta\beta_2$ and the fuel injection amount $\alpha$ is increase by ? $\alpha_2$ to bring the engine speed within the range of A1–A2. $\Delta\beta_2$ can be a predetermined value of a throttle position angle. The control routine then proceeds to the decision block P86.

In decision block P72, it is determined if the engine speed R is greater than or equal to the engine speed A2. If the engine speed R is not greater than or equal to the engine speed A2, the control routine 210 returns to decision block P60.

If, however, in decision block P72 it is determined that the engine speed R is greater than or equal to the engine speed A2, the control routine 210 proceeds to a decision block P74. In decision block P74 it is determined if the throttle position $\beta$ is less than or equal to an idle throttle position $\beta_0$. If it is determined that $\beta$ is not less than or equal to $\beta_0$, the control routine proceeds to an operation block P76 where a timer is reset.

The control routine 210 then proceeds to an operation block P78 where $\beta$ is reduced by changing the throttle position by a value $\Delta\beta_3$ and a fuel injection amount $\alpha$ is reduced by fuel injection value ? $\alpha_3$. $\Delta\beta_3$ can be a another predetermined value of a throttle position angle. The control routine 210 then proceeds to an operation block P86.

In the decision block P86, it is determined if the engine speed R is greater than or equal to a predetermined engine speed C. The engine speed C can represent an engine speed above all allowable engine speeds. If it is determined that the engine speed R is not greater than or equal to the predetermined engine speed C, the control routine 210 returns to decision block P60.

If, however, in decision block P86 it is determined that the engine speed R is greater than or equal to the predetermined engine speed C, the control routine 210 proceeds to the operation block P88 where fuel and/or ignition is stopped and an alarm is initiated. The alarm provides the rider with a warning of a watercraft and/or engine malfunction.

Returning to the operation block P74, if it is determined that the throttle opening $\beta$ is less than or equal to $\beta_0$, the routine 210 moves to an operation block P80.

In the operation block P80, $\beta$ is assigned the value of $\beta_0$. $\beta_0$ represents an idle speed throttle valve position. Since $\beta$ is assigned a value of $\beta_0$, $\alpha$ is assigned a value of $\alpha_0$ corresponding to the throttle position $\beta_0$.

The control routine 210 then proceeds to an operation block P82 where the timer is started. If the timer is already running, the timer is allowed to continue. The control routine then proceeds to a decision block P84 where it is determined if the timer T is greater than or equal to a value $T_0$. If the timer value T is not greater than or equal to a predetermined To, the control routine 210 proceeds to the decision block P86.

If, however, in decision block P84 it is determined that the timer T is greater than or equal to the predetermined timer value $T_0$, the control routine proceeds to an operation block P88 where the fuel injection and/or ignition is stopped. In this situation, the routine 210 has determined that the engine speed R has remained above A2 while the throttle valve opening $\beta$ and the fuel injection amount $\alpha$ were at idle speed values, for a predetermined period of time; an event that that would not normally occur unless there is a malfunction or abnormality. Thus, an alarm can also be triggered to indicate an abnormality or malfunction.

Figure 14:
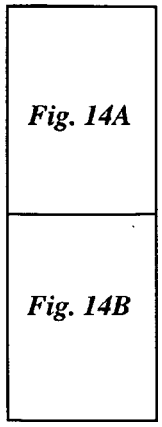
FIG. 14 is a block diagram showing another control routine arranged and configured in accordance with certain features, aspects and advantages of at least one of the inventions disclosed herein.

FIG. 14 illustrates a modification of the control routine 210, identified generally by the reference numeral 240. The control routine 240 shown in FIG. 14 is configured to control operation of the fuel injection system based on engine speed to prevent over-revving engine damage.

As shown in FIG. 14, the control routine 240 begins and moves to a first decision block P100. In the illustrated embodiment, the routine 240 can start as soon as a rider attempts to start the engine 12, for example as soon as the start button is activated. However, it is to be understood that the routine 240 can start at any time. Preferably, the memory locations M$\beta$, M$\alpha$, discussed below, are set to zero and the flag is cleared.

In operation block P100 a throttle opening angle $\beta$ is calculated using the position of the throttle lever 34 or throttle valve 102 and a corresponding fuel injection value $\alpha$ is calculated from the throttle opening angle $\beta$. The value of the calculated throttle opening $\beta$ is entered into memory as a value M$\beta$ and a corresponding fuel injection value $\alpha$ calculated from the throttle opening value $\beta$ is also entered into memory as a value $\alpha_x$. The control routine 240 then moves to decision block P102.

In decision block P102, it is determined if an engine stop signal is present. If an engine stop signal is present, the control routine moves to operation block P104 where the fuel and/or ignition are stopped.

If, however, in decision block P102 the control routine determines that a stop signal is not present, the control routine 240 proceeds to decision block P106 where the engine speed R is compared to the predetermined engine speed B. Preferably, the predetermined initial engine speed B is an engine speed that is higher than an engine speed that corresponds to a steady state full throttle/top speed operation where the intake duct of the jet propulsion unit is completely submerged. If the engine speed R is determined to be not greater than or equal to speed A, the control routine 240 returns to the beginning and repeats as long as the engine is running.

If, however, in decision block P106 the sensed engine speed R is greater than or equal to the speed B, the control routine proceeds to an operation block P108 where a predetermined cylinder disablement is initiated. Predetermined cylinder disablement can include cycling a single cylinder disablement between all cylinders to promote lowering engine output while maintaining smooth engine operation. When cylinder disablement is increased, more than one cylinder can be disabled and the cylinders that are disables disablement are cyclically changed to promote an even lower engine output while still maintaining smooth engine operation. The-control routine 240 then proceeds to decision block P110.

In decision block P110, it is determined if the watercraft is airborne. Determining if the watercraft has left the water, i.e. become airborne, can be accomplished through various systems. For example, these systems can include, but are not limited to, at least one of the pressure sensors 55 mounted on the lower hull 16 of the watercraft 10, which can include at least one sensor mounted in the vicinity of the jet pump inlet port 52, and/or in the vicinity of the jet pump tunnel 50. Other possibilities for determining if the watercraft 12 is airborne include monitoring the engine speed and detecting a sudden or an abnormal increase in engine speed.

If it is determined that the watercraft is not airborne, the control routine 240 proceeds to operation block P112 where the predetermined cylinder disablement is cancelled. The control routine 240 returns to the beginning and repeats as long as the engine is running. By reducing or canceling the rev-limiting action after it is determined that the watercraft is not airborne, the routine 240 provides an additional advantage in that the engine speed recovers quickly from the rev-limiting effect caused by operation block P108. Where it is determined that the watercraft is not airborne, it can be assumed that the excessive engine speed is transient, and the engine speed will likely drop quickly. Thus, by reducing the rev-limiting effect after it is determined that the watercraft is not airborne, watercraft speed can be maintained more smoothly.

If, however, in the decision block P110 it is determined that the watercraft is airborne, the control routine 240 proceeds to a decision block P114 where it is determined if the engine has rotated N times (in some embodiments, N can correspond to the number of revolutions needed to complete a combustion cycle, for a four-cycle engine, N equals two). If the engine is not rotated N times then the control routine 240 returns to decision block P 110 until the number of engine revolutions N is achieved.

Figure 13A:
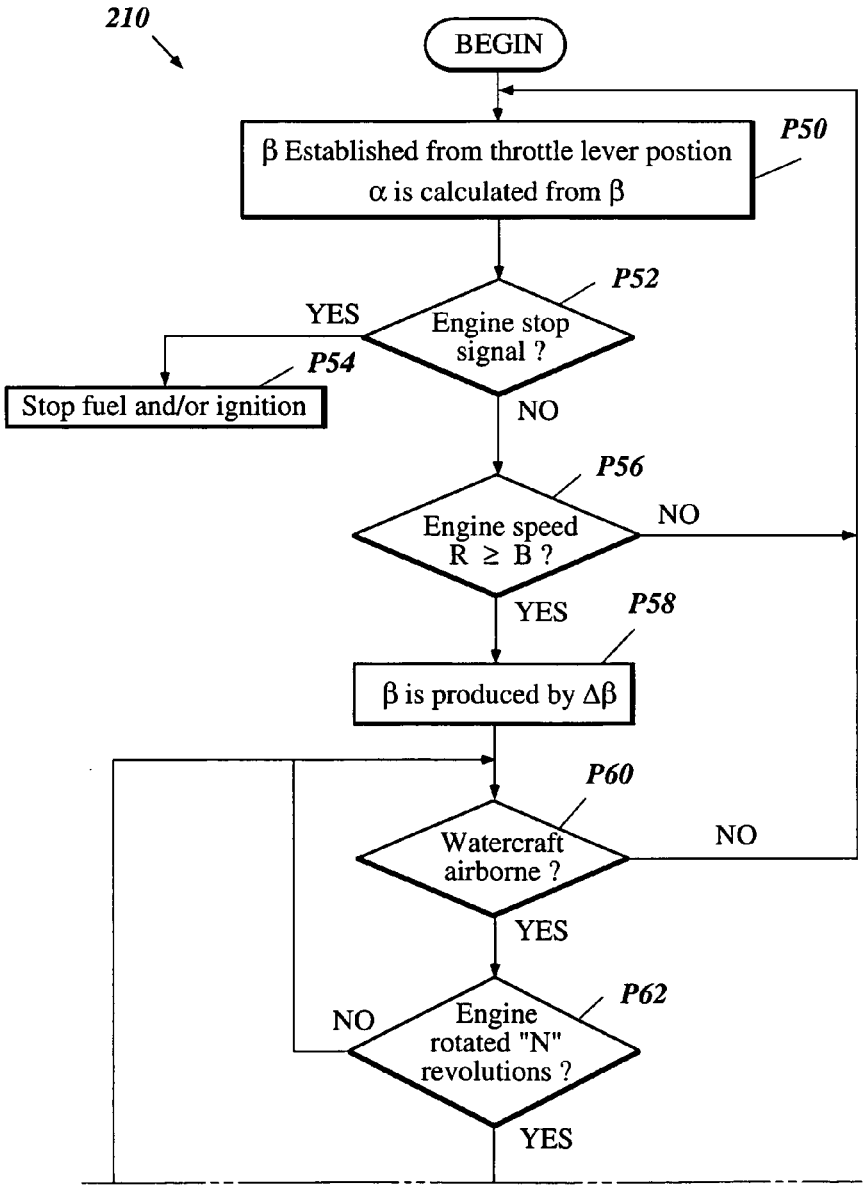
Figure 13B:
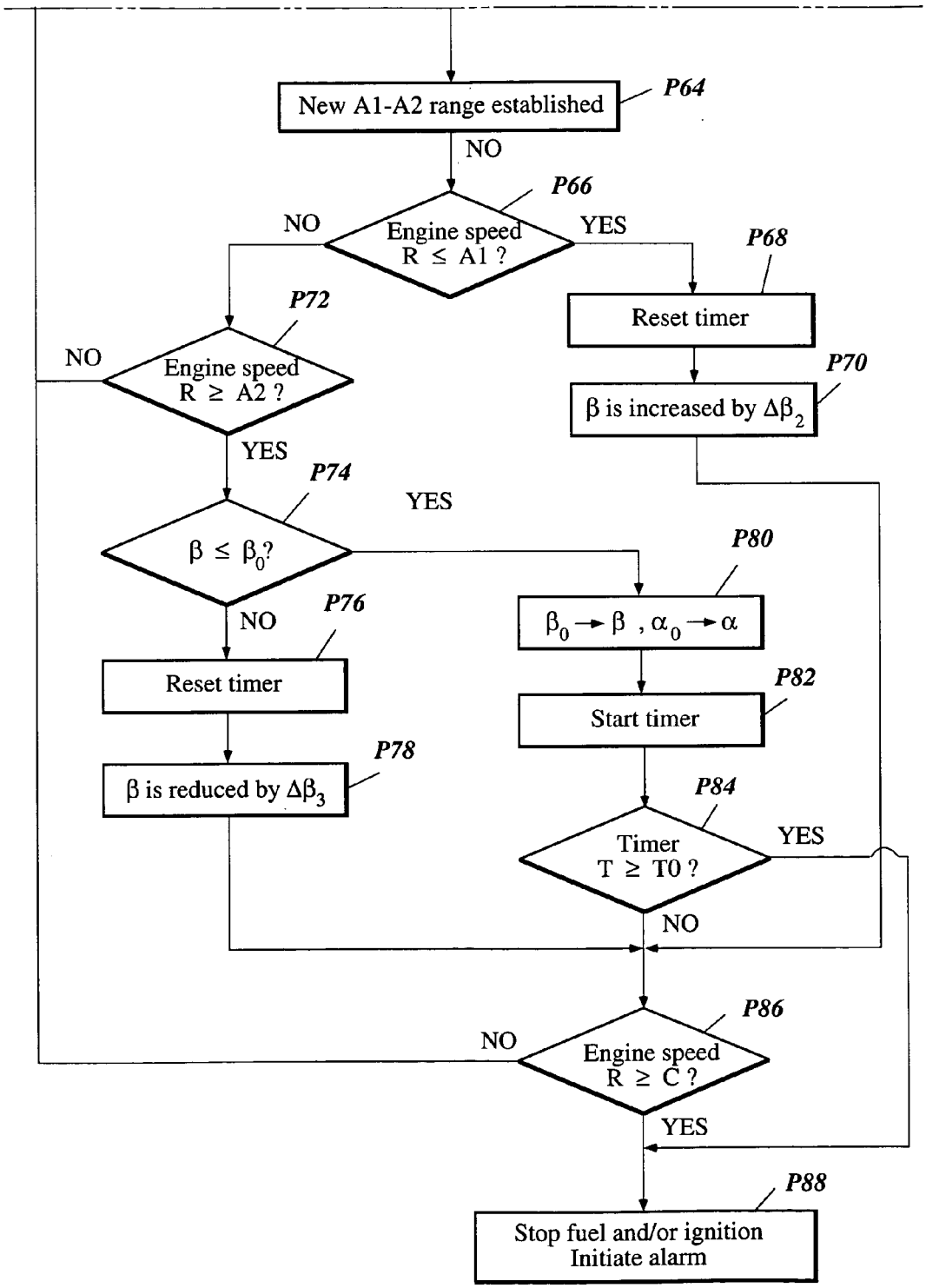

If, however, at the decision block P114, the engine has rotated N times, the control routine 240 moves to operation block P116 where the new engine speed range A1–A2 is determined. For example, the reference engine speed range A1–A2 can be determined from the throttle lever position (or throttle valve opening β where the throttle valve position is controlled directly by a conventional, non-compensated connection), as in the operation block P64 (FIG. 13B).

The control routine 240 then proceeds to decision block P118 where it is determined if an engine speed R is less than or equal to the engine speed A1. If the engine speed R is not less than or equal to the engine speed A1, the control routine 240 proceeds to a decision block P122.

In decision block P122, it is determined if the engine speed R is greater than or equal to the engine speed A2. If the engine speed R is not greater than or equal to the engine speed A2 the engine speed R is in the new range A1–A2. Thus, the control routine 240 returns to decision block P110.

If, however, in decision block P122 it is determined that the engine speed R is greater than or equal to the engine speed A2, the control routine 240 proceeds to a decision block P124. In decision block P124 it is determined if all cylinders are disabled except one. If in decision block P124 it is determined that not all cylinders are disabled except for one, the control routine proceeds to an operation block P126 where the predetermined cylinder disablement is increased. The control routine 240 then proceeds to an operation block P140.

In operation block P140 a timer is reset. The control routine then proceeds to a decision block P142 where it is determined if an engine speed R is greater than or equal to a predetermined engine speed C. The engine speed C can represent an engine speed above all allowable engine speeds. If it is determined that the engine speed R is not greater than or equal to the predetermined engine speed C, the control routine 240 returns to a decision block P110.

If, however, in decision block P142 it is determined that the engine speed R is greater than or equal to the predetermined engine speed B, the control routine 240 proceeds to the operation block P144. In the operation block P144, fuel injection and/or ignition is stopped to kill the engine. Optionally, an alarm can also be triggered to indicate an engine fault.

With reference again to decision block P124, if all the cylinders are disabled except for one, the control routine 240 proceeds to a decision block P128. In the decision block P128, it is determined whether the current injection value $\alpha_x$ is greater than (Mα+Δα), where Δα represents a bias fuel injection amount. The bias fuel injection amount Δα can be a predetermined amount which can aid in determining whether it is desirable to further reduce the current injection amount $\alpha_x$ or allow the new throttle position (stored in memory Mβ) to determine the new fuel injection-amount to be injected. If the current fuel injection value $\alpha_x$ is not greater than (Mα+Δα), then the routine 240 proceeds to an operation block P132 where further measures are taken to reduce engine speed. In some embodiments, the bias fuel injection amount Δα can be a positive or negative value.

The value Δα can be considered as corresponding to a predetermined threshold of throttle valve movement that must be exceeded before the control routine 240 will bypass the operation block P132. Thus, for example, if an operator maintains the throttle lever 34 in substantially the same position or further depresses the throttle valve when the control routine 240 reaches a decision block P128, the result in the decision block P128 will be negative, thereby causing the control routine 240 to proceed to the operation block P132 in which the actual fuel injection amount $\alpha_x$ is reduced by a reduction amount $\Delta\alpha_x$. Additionally, the value Δα can be set so that the result in the operation block P128 will also be negative when a rider of the watercraft 10 slowly releases the throttle valve 34 such that the throttle valve slowly closes.

However, if a rider of the watercraft suddenly releases the throttle valve, causing the value $\alpha_x$ to fall rapidly such that the result of decision block P128 is positive, i.e., the actual fuel injection amount $\alpha_x$ is not greater then (Mα+Δα), the control routine 240 moves on to operation block P130. For example, the amount of fuel injected by the fuel injector 118 is reduced from the amount of fuel normally injected for the current engine speed and throttle valve opening β. Thus, the magnitude of the value $\Delta\alpha_x$ is set to a value sufficient to reduce the power output from the engine. For example, the magnitude of the value $\Delta\alpha_x$ is large enough such that the mixture of air and fuel resulting therefrom is sufficiently lean so as to reduce the power produced by the combustion of this lean air and fuel mixture. Of course, the value of $\Delta\alpha_x$ could also be positive so as to produce a mixture that is sufficiently rich to reduce the power output of the engine 12.

Thus, when the control routine 240 reaches the operation block P130, the actual fuel injection amount $\alpha_x$ is determined based on the throttle opening β because the rider has either quickly closed or released the throttle lever 34 such that the engine speed R should drop about as quickly as or faster than the drop in engine speed generated by the operation block P132.

If, however, in the decision block P128 it is determined that $\alpha_x$ is greater than (Mα+$\Delta\alpha_x$), the control routine 240 proceeds to an operation block P130. As noted above, this result would occur if the rider released the throttle lever 34 prior to the operation block P116. Thus, in the operation block P130, the current fuel injection value $\alpha_x$ is changed to the value Mα (which corresponds to the new throttle valve opening β determined in block P116), thereby allowing the rider's release of the throttle lever 34 control the fuel injection amount, and thus, the power output of the engine 12. The control routine then proceeds to operation block P140.

The value Δα as noted above, provides a means for determining whether or not the speed at which the rider of the watercraft 10 releases the throttle lever 34 is sufficiently fast to slow the engine, or is the further action of changing the stoichiometry of combustion in the engine 12 to reduce engine speed R is desired. If the operator of the watercraft 10 releases the lever 34 quickly, the actual fuel injection amount $\alpha_x$ will also fall rapidly, without changing the stoichiometry of combustion within the engine 12. On the other hand, if the rider of the watercraft 10 does not release the throttle lever or releases the throttle lever slowly, the additional measure of reducing the power output of the engine 12 by changing the stoichiometry of the air and fuel mixture combusted within the engine 12, provides an additional manner for preventing the severe damage that can result from excessive engine speed. By changing the value of Δα, the threshold of the speed of throttle valve movement required to trigger the change in stoichiometry resulting from operation block P132 can be changed.

As noted above, in the operation block P130, the actual fuel injection amount $\alpha_x$ in effect is changed to the fuel injection amount Mα. Thus, when the control routine 240 reaches decision block P128 a second time, the value of (Mα+Δα) will be smaller than when the control routine 240 previously performs the decision block P128.

After the operation block P130, the routine 240 proceeds to operation block P140 and continues as described above.

However, in decision block P128, if it is determined that $\alpha_x$ is greater than (Mα+$\Delta\alpha_x$), the routine 240 proceeds to operation block P132. As noted above, in operation block P132, the actual fuel injection amount $\alpha_x$ is reduced by a reduction amount $\Delta\alpha_x$. For example, if the rider of the watercraft 10 does not reduce the throttle valve opening β, the control routine 240 will advance to the operation block P132, depending on the value of Δα.

The value of $\Delta\alpha_x$ can be a predetermined amount of a change in fuel injection amount sufficient to cause a reduction in engine speed R. In some embodiments, the amount $\Delta\alpha_x$ can be of a magnitude that the routine 240 can return to P132 a plurality of times in series, each time reducing the actual fuel injection amount by $\Delta\alpha_x$, and still provide enough fuel for the engine 12 to continue to operate. After the operation block P132, the routine 240 proceeds to operation block 134.

In the decision block P134, it determined if $\alpha_x$ is greater than $\alpha_0$, where $\alpha_0$ represents an idle fuel injection amount. If it is determined that $\alpha_x$ is not greater than $\alpha_0$, the control routine proceeds to operation block P140, and continues as described above.

If, however, in decision block P134 it is determined that $\alpha_x$ is not greater than $\alpha_0$, the control routine proceeds to an operation block P136 where a timer is initiated. If the timer is already running, it is allowed to continue running. The control routine 240 then proceeds to a decision block P138.

In decision block P138 it is determined if the timer value T is greater than or equal to a predetermined value $T_0$. If in decision block P138 it is determined that the timer T is not greater than or equal to the predetermined timer value $T_0$, the control routine 240 proceeds to the decision block P142, and continues as described above. In this situation, the fuel injection amount $\alpha_x$ has been reduced to an amount equal to or less than a fuel amount for idle speed $\alpha_0$ when only one cylinder is operating. If the routine 240 continues to return to operation block P138 (without the timer being reset for example in operation block P140), it is likely that there is a malfunction.

Thus, in decision block P138, if it is determined that the timer value T is greater than or equal to the predetermined time value $T_0$, the control routine 240 proceeds to the operation block P144 where fuel and/or ignition is stopped and an alarm is initiated. The alarm provides the rider with a warning of a watercraft and/or engine malfunction.

Returning to operation block P118, if the engine speed R is less than or equal to the engine speed A1, the control routine 240 proceeds to an operation block P120.

In operation block P120 the predetermined cylinder disablement is decreased in order to bring the engine speed into the predetermined engine speed range A1–A2. The control routine then proceeds to operation block P140, and continues as described above.

Figure 15:
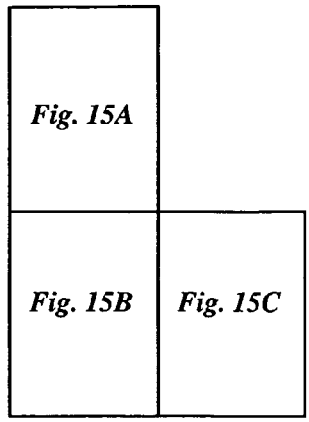
Figure 15A:
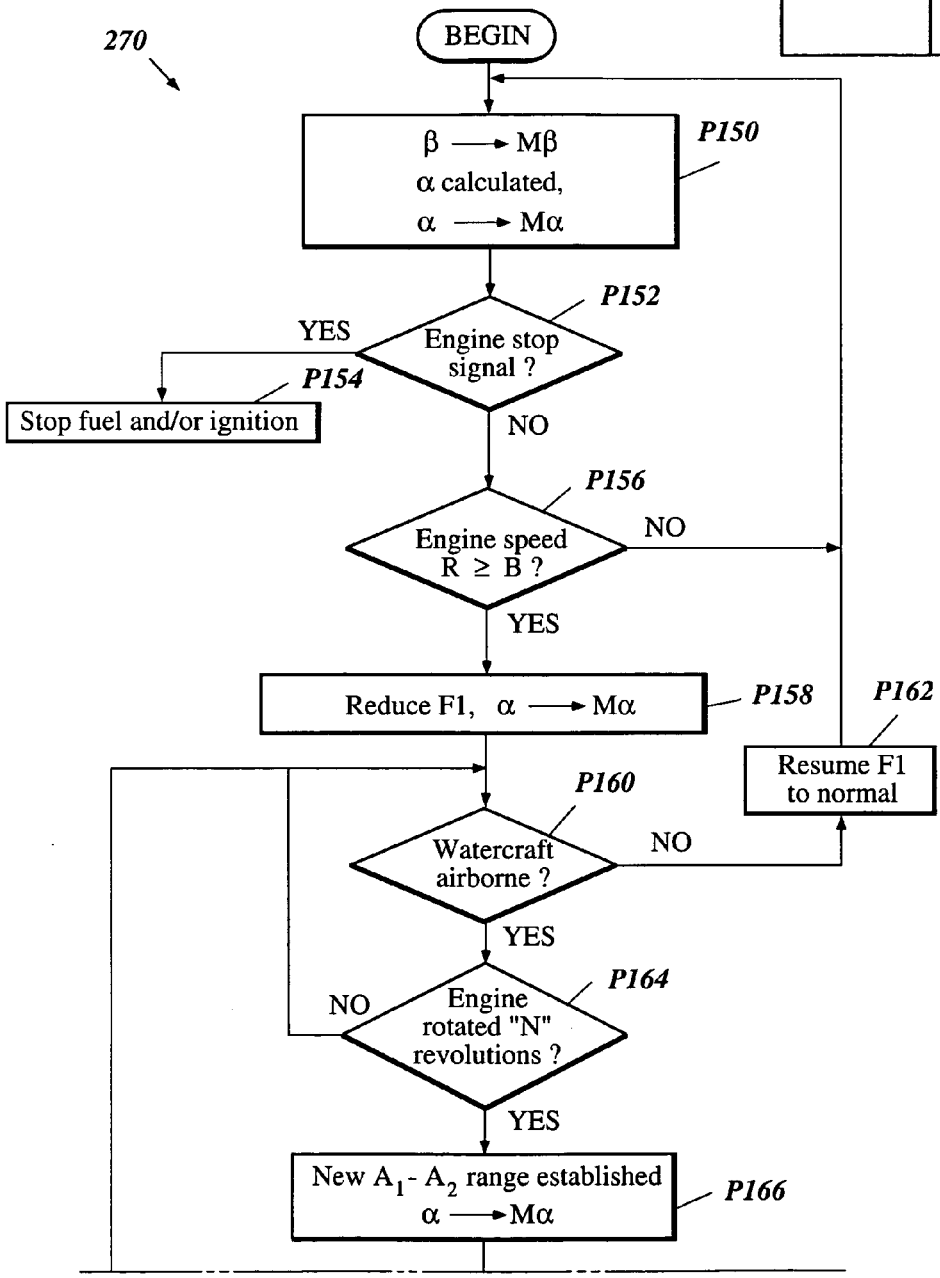
Figure 15B:
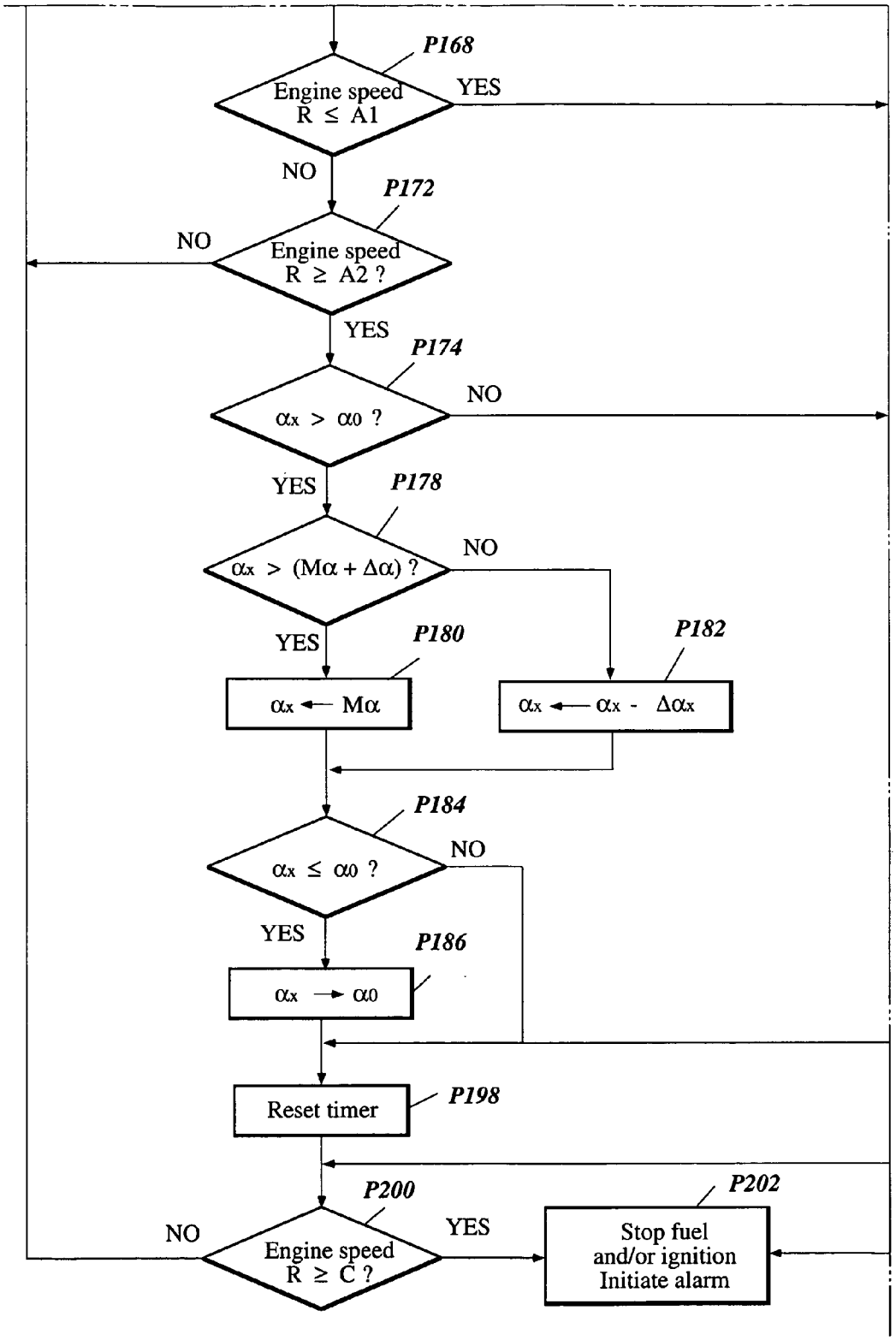

FIG. 15 illustrates another modification of the control routine 210 illustrated in FIG. 13, identified generally by the reference numeral 270. The control routine 270 is configured to control operation of the fuel injection based on engine speed to prevent over-revving engine damage and in response to jumps. As shown in FIG. 15, the control routine begins and moves to a first decision block P150. In the illustrated embodiment, the routine 270 can start as soon as a rider attempts to start the engine 12, for example as soon as the start button is activated. However, it is to be understood that the routine 270 can start at any time.

In operation block P150 a throttle valve position β is detected and a corresponding fuel injection amount α are calculated and stored in memory. Optionally, the position of the throttle lever 34 can be used as the β value in an embodiment where the throttle valves are electronically controlled. The throttle position value β becomes the memory value Mβ and the fuel injection value $\alpha_x$ becomes the memory of fuel injection value Mα. Accordingly, the ECU 98 utilizes the current fuel injection amount $\alpha_x$ for controlling the fuel injectors 118. The control routine 270 then moves to decision block P152.

In decision block P152, it is determined if an engine stop signal is present. If an engine stop signal is present, the control routine moves to operation block P154 where the fuel and/or ignition are stopped.

If, however, in decision block P152 the control routine determines that an engine stop signal is not present, the control routine 270 proceeds to decision block P156 where the engine speed R is compared to a predetermined engine speed B. Preferably, the predetermined engine speed B is an engine speed that is higher than an engine speed that corresponds to a steady state full throttle/top speed operation where the intake duct of the jet propulsion unit is completely submerged. If the engine speed R is determined to be not greater than or equal to speed B, the control routine 270 returns to the beginning and repeats as long as the engine 12 is running.

If, however, in decision block 156 the sensed engine speed R is greater than or equal to the engine speed B, then the control routine proceeds to an operation block P158 where fuel injection is reduced. For example, the new fuel injection amount can be determined as $\alpha_x$–? $\alpha_x$. For example, but without limitation, ? $\alpha_x$ can be a percentage such as 2%, 5%, 10%, 20%, etc. Preferably, when αx is large, a large ? $\alpha_x$ is used, and when $\alpha_x$ is small, a small ? $\alpha_x$ is used. The new value of the current fuel injection $\alpha_x$ is entered into the memory Mα. The control routine 270 then proceeds to a decision block P160.

Figure 14A:
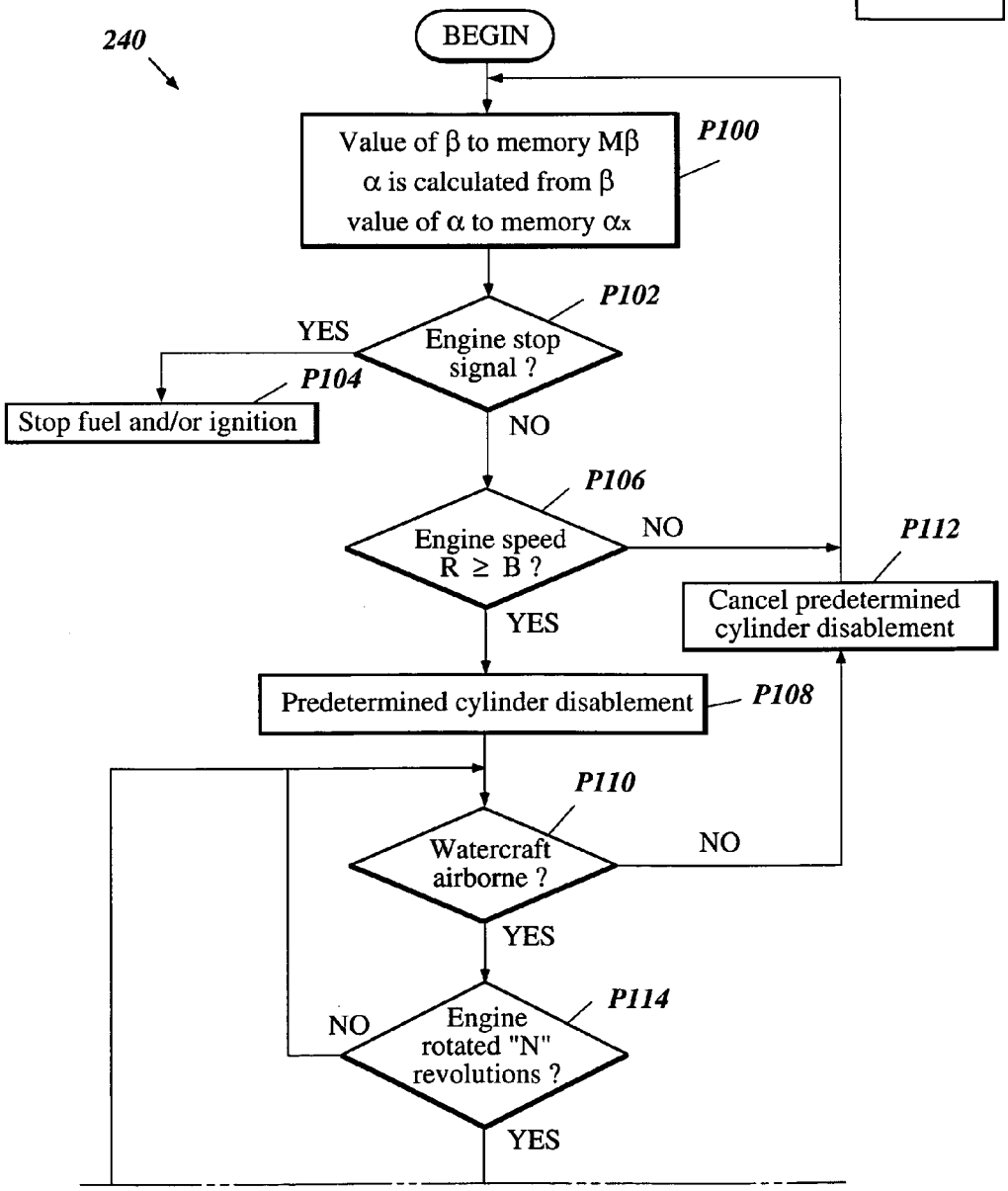

In decision block P160 it is determined if the watercraft is airborne. For example, but without limitation, the methods and devices described above with reference to decision blocks P60 (FIG. 13A) and P110 (FIG. 14A) can be used to determine with the watercraft is airborne. If it is determined that the watercraft is not airborne, the control routine 270 preferably proceeds to an operation block P162 where the current fuel injection value $\alpha_x$ is returned to a normal fuel injection value. The control routine 270 then returns to the beginning and repeats as long as the engine is running.

If, however, in decision block P160 it is determined that the watercraft is airborne, the control routine 270 proceeds to a decision block P164 where it is determined if the engine has rotated N times (N corresponding to the number of revolutions needed to complete a combustion, for a four-cycle, N=2). If the engine is not rotated N times, then the control routine 270 returns to decision block P160 until the number of engine revolutions N is achieved with the watercraft remaining airborne.

Figure 14B:
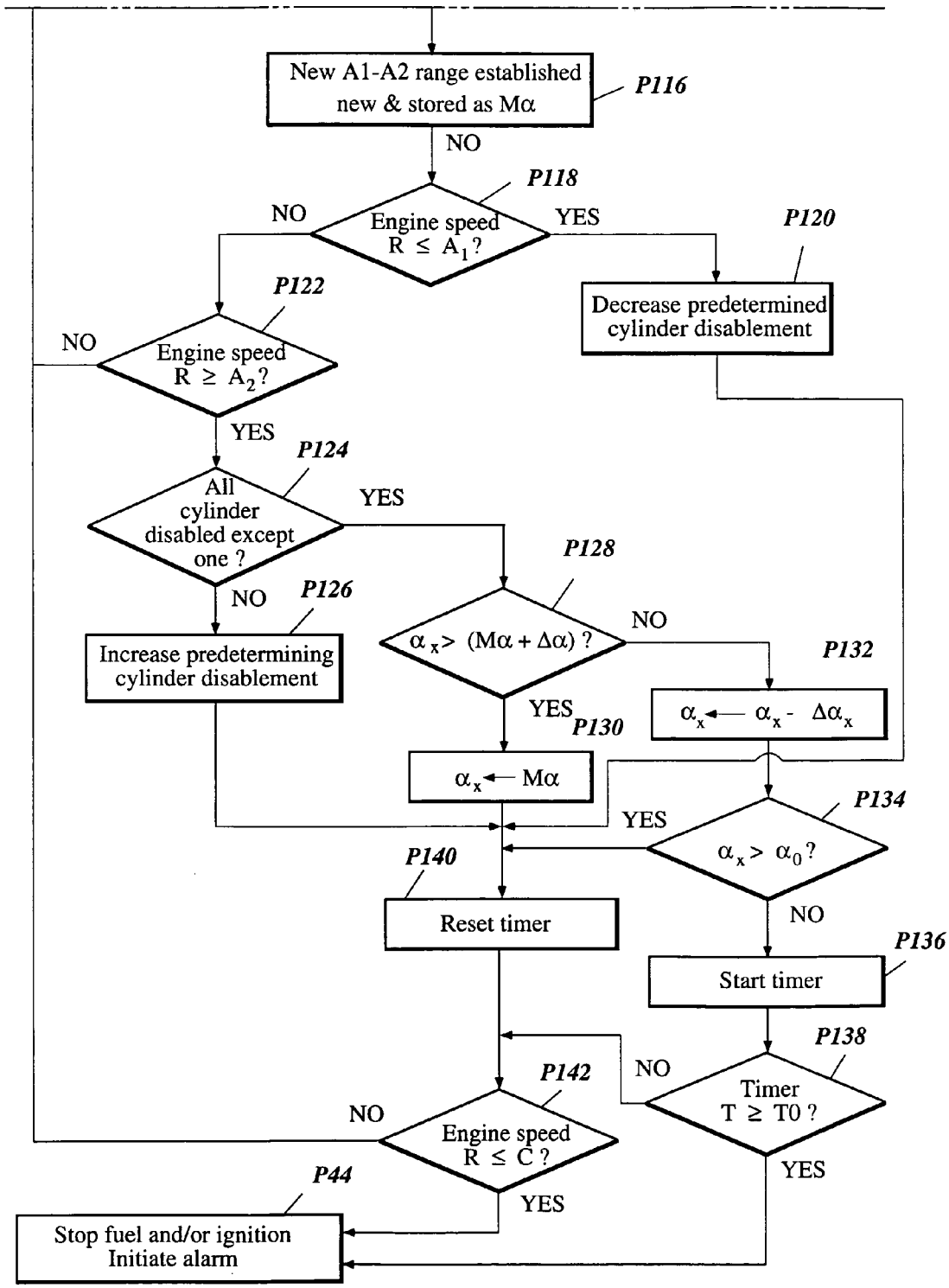

If, however, at the decision block P164 the engine has rotated N times, the control routine 270 moves to an operation block P166 where a reference engine speed range A1–A2 is determined. For example, the engine speed range A1–A2 can be determined by reference to the throttle valve position β, or any other method described above with reference to operation blocks P64 (FIG. 13B) and P116 (FIG. 14B). Additionally, a new α is determined based on the throttle valve position β. The new α is entered into the memory Mα.

The control routine 270 proceeds to a decision block P168 where it is determined if an engine speed R is less than or equal to the engine speed A1. If the engine speed R is not less than or equal to the engine speed A1, the control routine 270 proceeds to a decision block P172.

In decision block P172 it is determined if the engine speed R is greater than or equal to the engine speed A2. If the engine speed R is not greater than or equal to the engine speed A2, control routine 270 returns to decision block P160. As such, the engine speed is within the range A1–A2. Thus, the engine speed R remains within the desired range and the noise produced by the watercraft is controlled, thereby maintaining a comfortable riding experience.

If, however, in decision block P172 it is determined that the engine speed R is greater than or equal to the engine speed A2, the control routine 270 proceeds to a decision block P174 where it is determined if the current fuel injection value $\alpha_x$ is greater than the idle fuel injection value $\alpha_0$. If the current fuel injection value $\alpha_x$ is greater than the idle fuel injection value $\alpha_0$, the control routine proceeds to a decision block P176 (described in greater detail below).

If, however, in decision block P174 it is determined that the current fuel injection value $\alpha_x$ is not greater than the idle fuel injection value $\alpha_0$, the control routine 270 proceeds to a decision block P178.

In the decision block P178, it is determined if the current fuel injection value $\alpha_x$ is greater than the fuel injection amount in memory plus a predetermined change in fuel injection ($M\alpha+\Delta\alpha$). This determination is similar to the determination of decision block P128 of routine 240. Thus, the predetermined bias value Δα is set so as to provide means for determining if the throttle lever 34 has been moved sufficiently to allow the throttle lever position determine engine output, or if other means should be used to reduce engine speed R. If the query of decision block 178 is affirmative (YES), it means that the rider has not closed the throttle sufficiently to slow the engine into the A1–A2 range. Thus, the control routine 270 proceeds to an operation block P182.

In the operation block P182, the current fuel injection $\alpha_x$ is reduced by the predetermined change in fuel injection $\Delta\alpha_x$ (i.e., $\alpha_x=\alpha_x-\Delta\alpha_x$). The amount $\Delta\alpha_x$ can provide a reduction in the fuel injection amount sufficient to lower the engine speed. The control routine 270 then proceeds to a decision block P184 (described below).

If, however, the query of decision block P178 is negative (NO), the rider has released the throttle lever 34 or allowed the throttle lever 34 to close sufficiently that the engine speed should fall sufficiently quickly. Thus, the control routine proceeds to an operation block P180. In the operation block P180, the current fuel injection value $\alpha_x$ is reduced by recalling the fuel injection value stored in memory Mα (in operation block P166), and setting that memory value Mα as the current fuel injection value $\alpha_x$. This operation is similar to the operation of operation block P130 of routine 240. The control routine then proceeds to the decision block P184.

In decision block P184 it is determined if the (now reduced) current fuel injection value $\alpha_x$ is less than or equal to the idle fuel injection value $\alpha_0$. If the current fuel injection value $\alpha_x$ is less than or equal to the fuel injection idle value $\alpha_0$, the control routine 270 proceeds to an operation block P186 in which the current fuel injection value $\alpha_x$ is set to the idle fuel injection value $\alpha_0$, then to operation block P198 (described below).

If, however, in decision block P184, it is determined that the current fuel injection value $\alpha_x$ is not less than or equal to the idle fuel injection value $\alpha_0$, the control routine proceeds to the operation block P198.

In the operation block P198, the timer is reset. After the timer is reset, the routine 270 moves to a decision block P200.

In the decision block P200, it is determined if the engine speed R is greater than or equal to the reference engine speed C. If the engine speed R is greater than or equal to the reference engine speed C, the routine 270 moves to an operation block P202 in which the fuel injection and/or ignition is stopped, thereby stopping the engine. If the engine speed R is not greater than or equal to the reference engine speed C, the routine 270 returns to operation block 160.

Figure 15C:
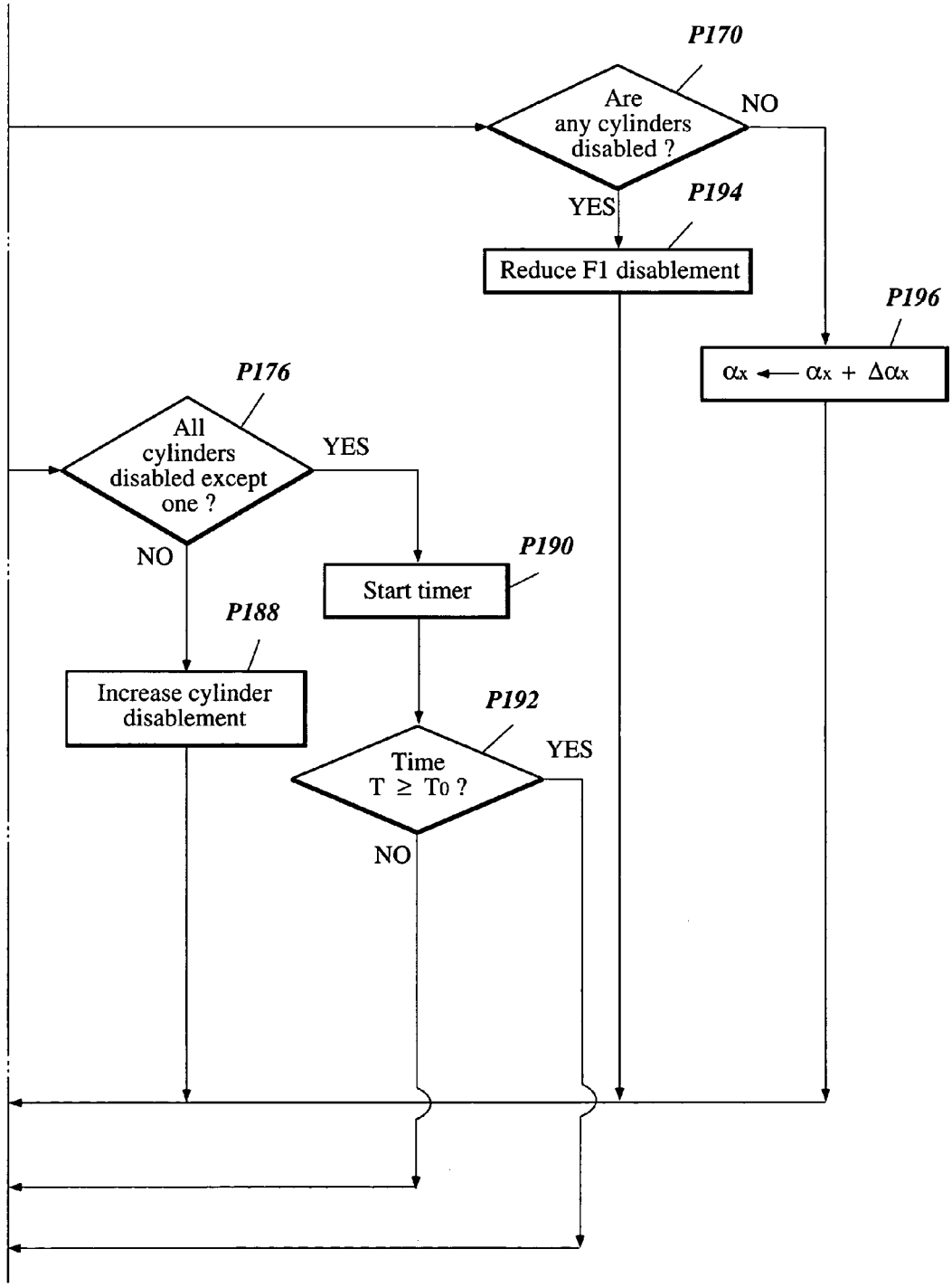

With reference again to the decision block P174, if the query therein is negative (NO), the routine moves to the decision block P176 (FIG. 15C). In the decision block P176 it is determined if all cylinders have been disabled except for one. If in decision block P176 it is determined that all cylinders have not been disabled except for one (i.e., there is more than one cylinder operating), the control routine 270 proceeds to an operation block P188 where cylinder disablement is increased (i.e., a cylinder is disabled, or if one cylinder is already disabled, an additional cylinder is disabled). The disablement of cylinders can be performed in accordance with the description set forth above with respect to control routines 170, 172, 210, and 140 and FIG. 11*a* and 11*b*. The control routine then proceeds to the operation block P198, and continues as described above.

If, however, in decision block P176 it is determined that all cylinders have been disabled except for one, the control routine 270 proceeds to an operation block P190 where a timer is initiated. If the timer is already running, it is allowed to continue to run. The control routine 270 then proceeds to a decision block P192.

In the decision block 192, it is determined if the timer value T is greater than or equal to the predetermined time T0. If it is determined that the timer T is not greater than or equal to the predetermined time T0, the control routine 270 proceeds to decision block P200 and continues as described above.

If, in the decision block 192, it is determined that the timer T is greater than or equal to the predetermined time T0, the control routine 270 proceeds to decision block P202, and stops the engine 12. In this situation, the current fuel injection amount $\alpha_x$ has been reduced to a value below that corresponding to an idle speed operation. Additionally, all of the cylinders have been disable except one. Finally, the affirmative result of decision block P192 means that the engine has been operating at a speed R above the reference speed A2, with only one cylinder operating at a below idle speed fuel injection rate, for at least a predetermined time. Thus, the engine 12 is stopped because it is likely that a malfunction has occurred.

Returning to decision block P168, if it is determined that the engine speed R is less than or equal to A1, the routine 270 proceeds to decision block 170. In decision block P170, it is determined if any cylinders have been disabled, for example, if the routine 270 has previously performed the operation block P188. If it is determined that a cylinder has been disabled, then the number is disabled cylinders is reduced, e.g., at least one cylinder is reactivated. The routine 270 then proceeds to operation block P198 and continues as described above.

If, however, in decision block P170 that no cylinders have been disabled, the control routine 270 proceeds to an operation block P196 where the current fuel injection value is increased by ? $\alpha_x$. In this situation, the routine has already performed operation block P158. Thus, the reduction of the fuel injection amount of operation block P158 is at least partially cancelled by the fuel injection amount increase of operation block P196, thereby at least partially restoring power output which should raise engine speed. The control routine then proceeds to operation block P198, and continues as described above.

Although at least one of the inventions disclosed herein has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. Moreover, not all of the features, aspects and advantages are necessarily required to practice at least one of the inventions disclosed herein. Accordingly, the scope of at least one of the inventions disclosed herein is intended to be defined only by the claims that follow.

What is claimed is:

1. A method of controlling a multi-cylinder marine engine associated with a watercraft, the method comprising injecting fuel into the engine for combustion therein, sensing a first engine speed, comparing the first sensed engine speed with a first predetermined speed, reducing fuel injection to at least a first cylinder if the first sensed engine speed is greater than the first predetermined speed, determining if the watercraft is airborne, and restoring fuel injection to the first cylinder if the watercraft is not airborne.

2. The method of claim 1 additionally comprising further reducing fuel delivery by a second fuel amount if the watercraft is airborne.

3. The method of claim 1 wherein reducing fuel injection comprises disabling the at least first cylinder.

4. The method of claim 1, wherein reducing fuel injection comprises reducing an amount of fuel injected into the first cylinder so as to result in an air/fuel mixture that is more lean than a stoichiometric air fuel mixture.

5. The method of claim 1 additionally comprising further reducing fuel injection in a step-wise manner until the fuel injection amount injected for all of the cylinders is about the same as an idle speed fuel injection amount.

6. The method of claim 5, additionally comprising disabling the cylinders of the engine in a step-wise manner if at least one of the engine speed remains above a second predetermined speed and the watercraft remains airborne.

7. The method of claim 1, wherein injecting fuel comprises injecting an approximately stoichiometric amount of fuel for combustion in the cylinder, the approximately stoichiometric amount of fuel being based on at least a position of a throttle valve configured to meter an amount of air flowing into the engine, the method additionally comprising injecting the approximately stoichiometric amount of fuel if the throttle valve has been moved towards a closed position.

8. The method of claim 1, additionally comprising stopping the engine if a less than idle speed amount of fuel has been injected for at least a predetermined amount of time and the engine speed remained above a second predetermined engine speed.

9. A watercraft comprising a hull, a multi-cylinder engine supported by the hull, a propulsion unit powered by the engine, and a controller configured to control at least fuel supply to the engine, the controller configured to detect a speed of the engine, compare the detected engine speed with a first predetermined speed, reduce fuel supply to at least a first cylinder of the engine if the detected engine speed is greater than a first predetermined speed, determine if the watercraft is airborne, and restore fuel supply to the at least first cylinder if the watercraft is not airborne.

10. The watercraft of claim 9 wherein the controller is further configured to further reduce fuel supply if the watercraft is airborne.

11. The watercraft of claim 9 wherein the controller is configured to reduce fuel supply by stopping all fuel supply to the at least first cylinder.

12. The watercraft of claim 9 additionally comprising a fuel injection system, wherein the controller is configured to reduce fuel supply by reducing an amount of fuel injected for combustion in the first cylinder so as to result in an air/fuel mixture that is more lean than a stoichiometric air fuel mixture.

13. The watercraft of claim 9, wherein the controller is configured to reduce fuel supply in a step-wise manner until the fuel supply amount for all of the cylinders is about the same as an idle speed fuel supply amount.

14. The watercraft of claim 9 wherein the controller is configured to disable the cylinders of the engine in a step-wise manner if at least one of the engine speed remains above a second predetermined speed and the watercraft remains airborne.

15. The method of claim 9 additionally comprising a fuel supply system and a throttle valve configured to meter an amount of air flowing into the first cylinder, wherein the controller is configured to cause the fuel supply system to supply an approximately stoichiometric amount of fuel for combustion in the first cylinder, based on at least a position of the throttle valve, the controller being configured to restore an approximately stoichiometric amount of fuel if the throttle valve has been moved towards a closed position, after the controller has determined that the watercraft is airborne.

16. The method of claim 9, wherein the controller is configured to stop the engine if a less than idle speed amount of fuel has been supplied for at least a predetermined amount of time and the engine speed remains above a second predetermined engine speed.

17. A watercraft comprising a hull, a multi-cylinder engine supported by the hull, a propulsion unit powered by the engine, and means for detecting a speed of the engine, comparing the detected engine speed with a first predetermined speed, reducing fuel supply to at least a first cylinder of the engine if the detected engine speed is greater than a first predetermined speed, determining if the watercraft is airborne, and restoring fuel supply to the at least first cylinder if the watercraft is not airborne.

* * * * *

UNITED STATES PATENT AND TRADEMARK OFFICE

CERTIFICATE OF CORRECTION

PATENT NO. : 7,018,254 B2
APPLICATION NO. : 10/873850
DATED : March 28, 2006
INVENTOR(S) : Isao Kanno It is certified that error appears in the above-identified patent and that said Letters Patent is hereby corrected as shown below:

At sheet 18 of 21, reference numeral P118 (Fig. 14B), line 2, please delete "$A_1$?" and insert -- A1? --, therefor.

At sheet 18 of 21, reference numeral P122 (Fig. 14B), line 2, please delete "$A_2$?" and insert -- A2? --, therefor.

At sheet 19 of 21, reference numeral P166, line 1, please delete "$A_1$-$A_2$" and insert -- A1-A2 --, therefor.

At column 1, line 7, after "2002" please insert -- , --.

At column 1, line 8, after "6,752,672" please insert -- , --.

At column 1, line 10, after "2001" please insert -- , --.

At column 3, line 42, please delete "herein; and." and insert -- herein. --, therefor.

At column 7, line 53, please delete "7A," and insert -- 7a, --, therefor.

At column 17, line 42, please delete "a" and insert -- α --, therefor.

At column 17, line 65, please delete "an" and insert -- a --, therefor.

At column 19, line 15, please delete "a" and insert -- an --, therefor.

UNITED STATES PATENT AND TRADEMARK OFFICE

CERTIFICATE OF CORRECTION

PATENT NO. : 7,018,254 B2
APPLICATION NO. : 10/873850
DATED : March 28, 2006
INVENTOR(S) : Isao Kanno It is certified that error appears in the above-identified patent and that said Letters Patent is hereby corrected as shown below:

At column 19, line 44, please delete "To," and insert -- $T_0$, --, therefor.

At column 20, line 40, please delete "The—control" and insert -- The control --, therefor.

At column 21, line 8, please delete "P 110" and insert -- P110 --, therefor.

At column 24, line 41, please delete "αx" and insert -- $\alpha_x$ --, therefor.

Signed and Sealed this

Fourteenth Day of April, 2009

JOHN DOLL
*Acting Director of the United States Patent and Trademark Office*